US008413623B2

(12) United States Patent
Takada et al.

(10) Patent No.: US 8,413,623 B2
(45) Date of Patent: Apr. 9, 2013

(54) INTERNAL COMBUSTION ENGINE WITH VARIABLE VALVE CONTROL SYSTEM

(75) Inventors: Yoshihiro Takada, Saitama (JP); Katsuhiro Kubo, Saitama (JP); Yuichi Tawarada, Saitama (JP); Masahiro Nakashima, Saitama (JP); Hiroyuki Natsui, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 873 days.

(21) Appl. No.: 12/586,225

(22) Filed: Sep. 18, 2009

(65) Prior Publication Data

US 2010/0077976 A1 Apr. 1, 2010

(30) Foreign Application Priority Data

Sep. 30, 2008 (JP) ..... 2008-254875

(51) Int. Cl.
*F01L 1/34* (2006.01)

(52) U.S. Cl.
USPC ..... 123/90.16; 123/90.44

(58) Field of Classification Search ..... 123/90.16, 123/90.39, 90.44; 74/559
See application file for complete search history.

(56) References Cited

U.S. PATENT DOCUMENTS

| | | | | |
|---|---|---|---|---|
| 3,878,822 | A | 4/1975 | Beal | |
| 4,253,434 | A | 3/1981 | Takizawa et al. | |
| 4,354,460 | A | 10/1982 | Mae et al. | |
| 4,584,974 | A | 4/1986 | Aoyama et al. | |
| 4,805,566 | A | 2/1989 | Ampferer | |
| 4,903,651 | A | 2/1990 | Matsuura et al. | |
| 7,966,982 | B2 * | 6/2011 | Tawarada et al. | 123/90.27 |
| 7,975,662 | B2 * | 7/2011 | Nakashima et al. | 123/90.16 |
| 7,980,213 | B2 * | 7/2011 | Warashina et al. | 123/90.16 |
| 8,136,492 | B2 * | 3/2012 | Takada et al. | 123/90.16 |
| 8,205,588 | B2 * | 6/2012 | Nakashima et al. | 123/90.39 |
| 2008/0236526 | A1 | 10/2008 | Yamamoto et al. | |
| 2008/0264369 | A1 | 10/2008 | Yamamoto et al. | |

FOREIGN PATENT DOCUMENTS

| | | |
|---|---|---|
| DE | 10 2008 020155 | 10/2008 |
| JP | 57-188904 | 11/1982 |
| JP | 58-190507 | 11/1983 |
| JP | 58-190507 A | 11/1983 |
| JP | 61-252815 A | 11/1986 |
| JP | 62-000711 | 1/1987 |
| JP | 62-018306 U | 11/1987 |
| JP | 62-184115 U | 11/1987 |
| JP | 62-184117 | 11/1987 |
| JP | 62-184117 U | 11/1987 |
| JP | 62-185810 U | 11/1987 |

* cited by examiner

*Primary Examiner* — Thomas Denion
*Assistant Examiner* — Daniel Bernstein
(74) *Attorney, Agent, or Firm* — Carrier Blackman & Associates, P.C.; Joseph P. Carrier; William D. Blackman

(57) ABSTRACT

An internal combustion engine is equipped with a variable valve control system which is operable to selectively actuate an engine valve using one of two cams of a camshaft, by sliding a rocker arm in the axial direction of a rocker-arm shaft. The system is capable of restricting the axial-direction movement of the rocker arm within a predetermined range, using a simple structure without unduly increasing the number of component parts. Position-restriction portions are formed in a rocker arm, and abut on a trigger arm to restrict sliding movement of the rocker arm within a predetermined amount, when the trigger arm is disengaged from the rocker arm.

20 Claims, 22 Drawing Sheets

INTERNAL COMBUSTION ENGINE WITH VARIABLE VALVE CONTROL SYSTEM

CROSS-REFERENCE TO RELATED APPLICATIONS

The present invention claims priority under 35 USC 119 based on Japanese patent application No. 2008-254875, filed on Sep. 30, 2008. The entire subject matter of this priority document, including specification claims and drawings thereof, is incorporated by reference herein.

BACKGROUND OF THE INVENTION

1. Field of the Invention

The present invention relates to an internal combustion engine equipped with a variable valve control system.

2. Description of the Background Art

There has been a conventional internal combustion engine (also referred to as an engine) designed to switch the valve actions by use of a rocker arm. The rocker arm is disposed to link an engine valve with first and second cams that serve the engine valve and is supported by a rocker-arm shaft swingably and slidably in the axial direction of the rocker-arm shaft. By sliding on the rocker-arm shaft in the axial direction, the rocker arm engages selectively with one of the two cams to switch the valve actions (see, for example, Patent Document 1).

In this variable valve control system, an end face of a bearing for the rocker-arm shaft is disposed, as position-restriction means that works when the rocker arm moves slidingly, at the restriction position for the sliding movement of the rocker arm. Thus, the rocker arm abuts on the bearing and thereby is restricted in the sliding movement.

PATENT DOCUMENT 1 JP-A-62-184117

In the above-described conventional configuration, since the bearing for the rocker-arm shaft is used as the position-restriction means, no extra means specially dedicated to this end is necessary. The layout of the bearing, however, sometimes does not allow the position-restriction means to be disposed at an appropriate position for the restriction on the sliding movement. In addition, the end face of the bearing is usually made of an aluminum alloy, so that it is difficult to make the end face strong enough to withstand the impact given by the sliding movement of the rocker arm. If, however, a portion blocking the sliding movement is formed as a separate member, the number of component parts is increased.

An object of the present invention, therefore, is providing an internal combustion engine equipped with a variable valve control system which switches the actions of an engine valve by sliding a rocker arm in the axial direction of the rocker-arm shaft, while enabling the axial-direction movement of the rocker arm to be restricted within a predetermined amount, by employing a simple structure without increasing the number of component parts.

SUMMARY OF THE INVENTION

In order to achieve the above objects, For the purpose of solving the above-mentioned problems, a first aspect of the present invention provides an internal combustion engine (e.g., an engine 1 in the embodiment) equipped with a variable valve control system in which: a rocker arm (e.g., rocker arms 13 and 17 in the embodiment) is disposed between an engine valve (e.g., an intake and an exhaust valves 6 and 7 in the embodiment) and a first and a second cams (e.g., a left-hand a right-hand first cams 15*a* and 16*a* as well as a left-hand and a right-hand second cams 15*b* and 16*b* in the embodiment) for the engine valve; the rocker arm is supported by a rocker-arm shaft (e.g., rocker-arm shafts 14 and 18 in the embodiment) swingably and slidably in an axial direction of the rocker-arm shaft; and the rocker arm slides in the axial direction in response to the movement of the rocker-arm shaft, and thereby engages selectively with one of the two cams, whereby actions of the engine valve are switched from one to the other. The internal combustion engine includes a stopper (e.g., a trigger arm 33 in the embodiment) provided separately from the rocker arm, and swingably supported by a cylinder head of the internal combustion engine by use of a support shaft (e.g., a support shaft 32 in the embodiment) being in parallel with the rocker-arm shaft. When the stopper swings towards the rocker arm and engages with the rocker arm, the rocker arm is prohibited from sliding. When the stopper swings away from the rocker arm and disengages from the rocker arm, the rocker arm is allowed to slide. The rocker arm includes position-restriction means (e.g., position-restriction portions 41 and 42 in the embodiment) that abuts on the stopper so as to restrict the sliding movement of the rocker arm within a predetermined amount when the stopper disengages from rocker arm.

A second aspect of the present invention provides an internal combustion engine equipped with a variable valve control system with the following additional features. The rocker arm includes an engagement groove (e.g., engagement grooves 36*a*, 36*b*, and 36*c* in the embodiment) formed therein, the engagement groove configured to engage with an engagement nail (e.g., engagement nails 34 and 35 in the embodiment) of the stopper to prohibit the rocker arm from sliding. The position-restriction means is formed as a protrusion that is formed by extending a sidewall of the engagement groove.

A third aspect of the present invention provides an internal combustion engine equipped with a variable valve control system with the following additional features. In the stopper, a protruding piece (e.g., protruding pieces 43 and 44 in the embodiment) is provided as a separate body from the engagement nail and is configured to abut on the position-restriction means.

A fourth aspect of the present invention provides an internal combustion engine equipped with a variable valve control system with the following additional features. The engagement nail is made of a plate-shaped member that extends from a support-shaft side of the stopper towards the rocker arm. In the plate-shaped member, the protruding piece is formed in a location opposed to the engagement nail across a cut-away portion (e.g., cut-away portions 45 and 46 in the embodiment) that has an open side facing the rocker arm.

A fifth aspect of the present invention provides an internal combustion engine equipped with a variable valve control system with the following additional features. A pair of the engagement nails are arranged in the axial direction of the support shaft, and a pair of the protruding pieces are arranged in the axial direction of the support shaft. The cut-away portion has a chevron shape when viewed in the axial direction of the support shaft. The stopper includes a connecting portion (e.g., a connecting wall 33*b* in the embodiment) formed therein, the connecting portion configured to connect the engagement nails with each other and the protruding pieces with each other in a vicinity of a vertex of the cut-away portion that has a chevron shape when viewed in the axial direction of the support shaft.

A sixth aspect of the present invention provides an internal combustion engine equipped with a variable valve control system with the following additional features. The vertex angle of the cut-away portion is an obtuse angle.

EFFECTS OF THE INVENTION

According to the first aspect of the present invention, the stopper that engages with the rocker arm to prohibit the sliding movement of the rocker. In addition, when the stopper disengages from the rocker arm to allow the sliding movement of the rocker arm, the position-restriction means formed in the rocker arm abuts on the stopper so that the sliding movement of the rocker arm can be restricted within a predetermined amount. Consequently, the sliding movement of the rocker arm can be restricted within the predetermined amount by means of a simple structure without increasing the number of component parts.

According to the second aspect of the present invention, the position-restriction means is formed as a protrusion that has a sidewall contiguously formed from the sidewall of the engagement groove. Accordingly, when the engagement nail disengages from the engagement groove, the engagement nail can be guided smoothly along the sidewall of the engagement groove. Consequently, the restriction imposed by the engagement nail on the sliding movement of the rocker arm can be cancelled smoothly. In addition, the position-restriction means can be formed easily.

According to the third aspect of the present invention, the protruding piece that is formed as a separate body from the engagement nail abuts on the position-restriction means of the rocker arm. Accordingly, in contrast to the case where the restriction on the sliding movement of the rocker arm is imposed by the engagement nail alone, the load that derives from the restriction on the sliding movement of the rocker arm can be received also by the protruding piece. The influence on the engagement nail can be reduced so that the restriction imposed on the sliding movement of the rocker arm can be accomplished reliably and accurately.

According to the fourth aspect of the present invention, both the engagement nail and the protruding piece are formed as parts of the plate-shaped member that extends from the support-shaft side of the stopper towards the rocker arm. Consequently, the engagement nail and the protruding piece can be formed easily without increasing the number of component parts.

In addition, the engagement nail and the protruding piece are formed so as to be separated from each other with the cut-away portion in between. Consequently, the influence that the abutting of the protruding piece on the position-restriction means has on the engagement nail can be reduced.

According to the fifth aspect of the present invention, the engagement nails are connected with each other and the protruding pieces are connected with each other so that the engagement nails and the protruding pieces can have higher rigidity. In addition, the portion in the vicinity of the vertex of the cut-away portion that has a chevron shape when viewed in the axial direction of the support shaft (i.e., in the vicinity of the support shaft) can be reinforced. Consequently, the influence that the abutting of the protruding piece on the position-restriction means has on the engagement nail can further be reduced.

According to the sixth aspect of the present invention, the concentration of stress on the vicinity of the vertex of the cut-away portion can be reduced. In addition, the separation of the engagement nail from the protruding piece results in a further reduction in the influence that the abutting of the protruding piece on the position-restriction means has on the engagement nail.

For a more complete understanding of the present invention, the reader is referred to the following detailed description section, which should be read in conjunction with the accompanying drawings.

Throughout the following detailed description and in the drawings, like numbers refer to like parts.

BRIEF DESCRIPTION OF THE DRAWINGS

FIG. 17 is a right-side view illustrating areas surrounding cylinders of the engine while the area is the place that the hydraulic actuator is assembled to.

DETAILED DESCRIPTION OF ILLUSTRATIVE EMBODIMENTS

Figure 1:
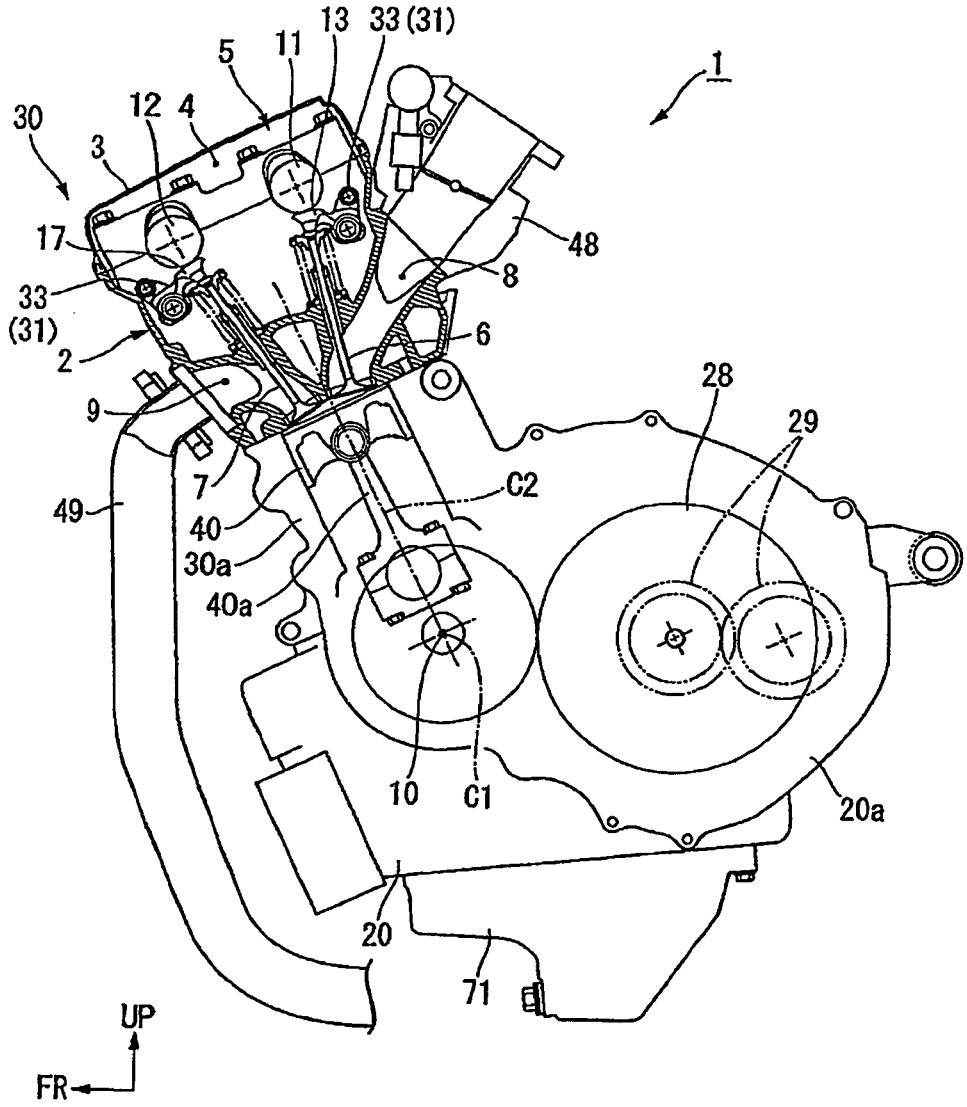
FIG. 1 is a left-side view of an engine according to an embodiment of the present invention.

An embodiment of the present invention will now be described, with reference to the drawings. Throughout this description, relative terms like "upper", "lower", "above", "below", "front", "back", and the like are used in reference to a vantage point of an operator of the vehicle, seated on the driver's seat and facing forward. It should be understood that these terms are used for purposes of illustration, and are not intended to limit the invention.

An embodiment of the present invention is now described by referring to the drawings. In the following description, the terms indicating directions, such as forwards, rearwards, leftwards, and rightwards, refer to their respective ones seen from the driver of the vehicle. The arrows FR, LH, and UP in the drawings indicate the front-side, the left-hand side, and the upside of the vehicle, respectively.

FIG. 1 shows a left-side view of an engine (internal combustion engine) 1, which is the prime mover of a saddle-ride type vehicle such as a motorcycle. The engine 1 is a transversely-mounted in-line four-cylinder engine with a rotational center axis C1 of a crankshaft 10 (simply referred to as a crankshaft axis) aligned in the vehicle width direction (in the right-and-left direction). Cylinders 30 stand on top of a crankcase 20 so as to tilt forwards (i.e., the upper portion of each cylinder positioned forward of the lower portion thereof).

The cylinders 30 are arranged along the crankshaft axis C1. Pistons 40 are fitted respectively to the cylinders 30 so as to be movable reciprocally. The reciprocating movements of the pistons 40 are converted to rotating movement of the crankshaft 10 by means of connecting rods 40*a*. Throttle bodies 48 are connected respectively to the rear sides of the cylinders 30 while exhaust pipes 49 are connected respectively to the front sides of the cylinders 30. A line denoted by C2 in FIG. 1 represents the cylinder center axis (simply referred to as a cylinder axis), which extends in the direction in which each cylinder 30 stands.

A transmission case 20*a* is contiguously formed from the rear side of the crankcase 20. A transmission 29 is installed in the transmission case 20*a*, and a clutch 28 is installed in the right-hand side portion of the transmission case 20*a*. The power of rotating crankshaft 10 is outputted to the outside of the engine by means of the clutch 28 and the transmission 29.

Each cylinder 30 includes a cylinder body 30*a*, a cylinder head 2, and a head cover 3. The cylinder body 30*a* is formed on top of the crankcase 20 integrally (or, may be assembled as a separate body to the top of the crankcase 20). The cylinder head 2 is assembled to the top of the cylinder body 30*a*. The head cover 3 is assembled to the top of the cylinder head 2. In a valve chamber 4 formed by the cylinder head 2 and the head cover 3, a valve mechanism (valve system) 5 for driving intake valves 6 and exhaust valves 7 is installed.

An intake port 8 is formed in a rear-side portion of each cylinder head 2, and an exhaust port 9 is formed in a front-side portion thereof. A pair of combustion-chamber side openings are formed respectively by the intake and exhaust ports 8 and 9, and are opened and closed by the intake and exhaust valves 6 and 7, respectively. The engine 1 of this embodiment adopts the four-valve system; a right-and-left pair of intake valves 6 and a right-and-left pair of exhaust valves 7 are provided for each cylinder 30.

Figure 2:
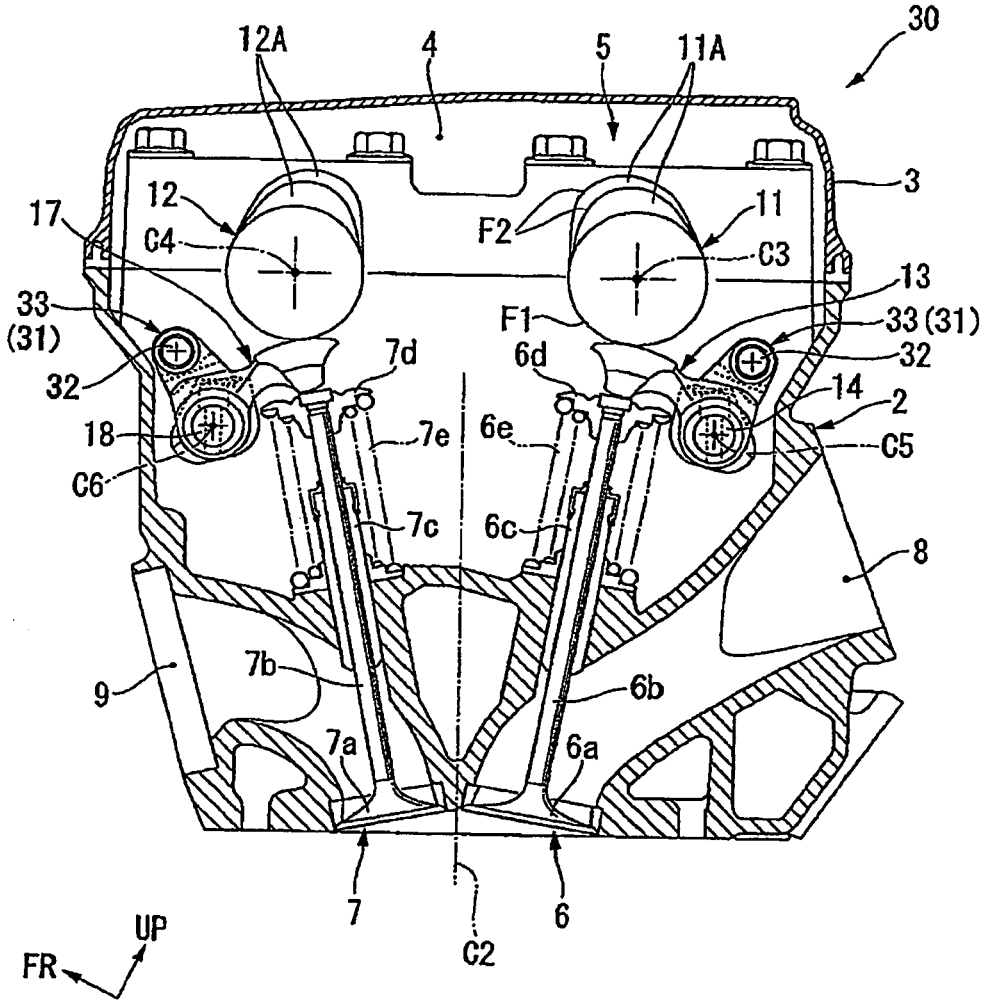
FIG. 2 is a left-side view illustrating areas surrounding a cylinder head of the engine.

As shown in FIG. 2, the intake and exhaust valves 6 and 7 each include a parasol-shaped valve head 6*a* or 7*a* fitted to the combustion-chamber side opening, and a rod-shaped stem 6*b* or 7*b* extending toward the valve chamber 4. The stems 6*b* and 7*b* of the intake and exhaust valves 6 and 7 are reciprocatively held by the cylinder head 2 with valve guides 6*c* and 7*c*, respectively. Retainers 6*d* and 7*d* are fixed respectively to the leading-end portions of the stems 6*b* and 7*b* that are located in the valve chamber 4). Valve springs 6*e* and 7*e* are each compressively provided between the retainer 6*d* or 7*d* and a seating formed in the cylinder head 2. When the intake and exhaust valves 6 and 7 are biased upward by a spring force of the valve springs 6*e* and 7*e*, the valve heads 6*a* and 7*a* close the combustion-chamber side openings, respectively. In contrast, when the intake and exhaust valves 6 and 7 are pressed downward against the biasing force by a stroke, the valve heads 6*a* and 7*a* of the intake and exhaust valves 6 and 7 are made to depart from and to open the combustion-chamber side openings.

Each of the stems 6*b* and 7*b* of the intake and exhaust valves 6 and 7 are provided obliquely relative to the cylinder axis C2 to form a V-shape when viewed from a side. An intake-side cam shaft 11 extending in the right-and-left direction is provided above the stems 6*b*, and an exhaust-side cam shaft 12 extending in the right-and-left direction is provided above the stems 7*b*. Each of the cam shafts 11 and 12 is supported by the cylinder head 2 rotatably on its own axis. While the engine 1 is running, the cam shafts 11 and 12 are linked with and driven by the crankshaft 10 by use of a chain transmission mechanism. The points denoted by C3 and C4 in FIG. 2 are center axes of the cam shafts 11 and 12 (simply referred to as cam axes) respectively.

An intake-side rocker arm 13 is provided for each cylinder 30, and helps cams 11A formed on the intake-side cam shaft 11 to press the right-and-left pair of intake valves 6 for each single cylinder 30. The right-and-left pair of intake valves 6 are opened and closed by being thus pressed. Likewise, an exhaust-side rocker arm 17 is provided for each cylinder 30, and helps cams 12A formed on the exhaust-side cam shaft 12 to press the right-and-left pair of exhaust valves 7 for each single cylinder 30. The right-and-left pair of exhaust valves 7 are opened and closed by being thus pressed.

An intake-side rocker-arm shaft 14 is provided at the rear side of the leading-end portions of the stems 6*b* of the intake valves 6 so as to be parallel with the intake-side cam shaft 11. The intake-side rocker-arm shaft 14 supports the intake-side rocker arm 13 so that the intake-side rocker arm 13 can swing about the axis of the intake-side rocker-arm shaft 14 and can slide in the axial direction of the intake-side rocker-arm shaft 14. An exhaust-side rocker-arm shaft 18 is provided at the front side of the leading-end portions of the stems 7*b* of the exhaust valves 7 so as to be parallel with the exhaust-side cam shaft 12. The exhaust-side rocker-arm shaft 18 supports the exhaust-side rocker arm 17 so that the exhaust-side rocker arm 17 can swing about the axis of the exhaust-side rocker-arm shaft 18 and can slide in the axial direction of the exhaust-side rocker-arm shaft 18. The points denoted by C5 and C6 in FIG. 2 are center axes of the rocker-arm shafts 14 and 18 (simply referred to as rocker axes) respectively.

Figure 5:
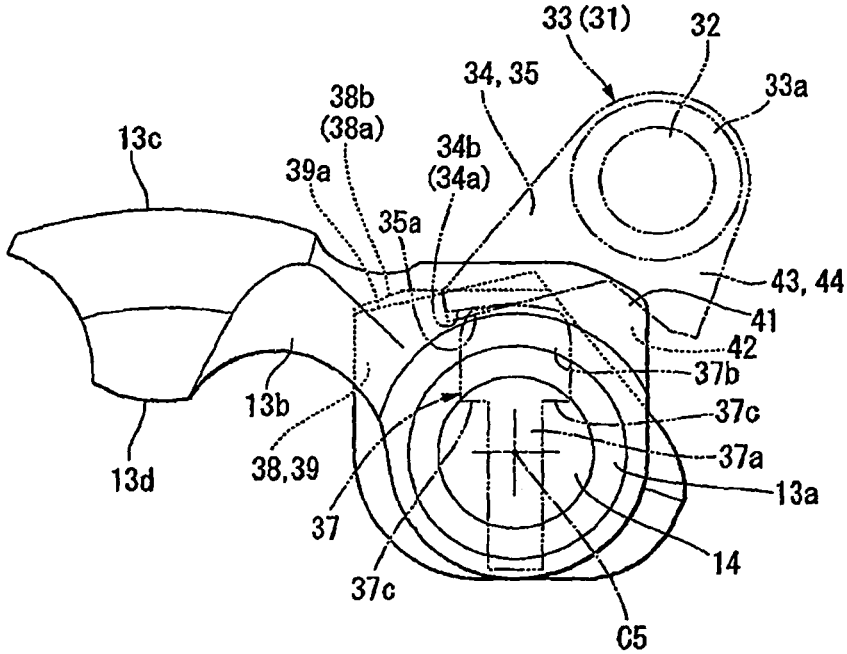
FIG. 5 is a left-side view illustrating areas surrounding the rocker arm in the state shown in FIG. 4.

Now refer also to FIGS. 3 and 5. The rocker arm 13 includes a cylindrical base portion 13*a*, and the intake-side rocker-arm shaft 14 is inserted into the base portion 13*a* (accordingly, the base portion 13*a* is also referred to as a shaft-insertion boss). Arm portions 13*b* extend respectively from the base portions 13*b* towards the leading-end portions of the stems 6*b* of the corresponding intake valves 6. A cam slidingly-contact portion 13*c* is formed in the upper-side portion of the leading-end portion of each of the arm portions 13*b*. The cam slidingly-contact portion 13*c* is the place that the cam 11A of the intake-side cam shaft 11 is brought into sliding contact with. A valve pressing portion 13*d* is formed in the lower-side portion of the leading-end portion of each of the arm portions 13*b*. The valve pressing portion 13*d* is the portion that is brought into contact with and presses downwards the leading-end portion of the corresponding stem 6*b*.

Though no drawing that describes in detail the exhaust-side rocker arm 17 is given, the exhaust-side rocker arm 17 has a similar configuration to that of the intake-side rocker arm 13. Specifically, the exhaust-side rocker arm 17 includes a cylindrical base portion, an arm portion, a cam slidingly-contact portion, and a valve pressing portion. The exhaust-side rocker-arm shaft 18 is inserted into the base portion (shaft-insertion boss). The arm portion extends from the base portion towards the leading-end portions of the stems 7*b* of the exhaust valves 7. The cam slidingly-contact portion is formed in the upper-side portion of the leading-end portion of the arm portion. The cam slidingly-contact portion is the place that the cam 12A of the exhaust-side cam shaft 12 is brought into sliding contact with. The valve pressing portion is formed in the lower-side portion of the leading-end portion of the arm portion. The valve pressing portion is the portion that is brought into contact with and presses downwards the leading-end portion of the stem 7*b*.

While the engine 1 is running, the cam shafts 11 and 12 that are linked with the crankshaft 10 are driven to rotate. The rocker arms 13 and 17 swing in accordance with the profiles of the cams 11A and 12*a* respectively at appropriate timings, so that the rocker arm 13 presses the intake valves 6 and the rocker arm 17 presses the exhaust valves 7. Thus, the intake and exhaust valves 6 and 7 reciprocally move to appropriately open and close their respective combustion-chamber side openings of the intake and the exhaust ports 8 and 9.

Figure 17:
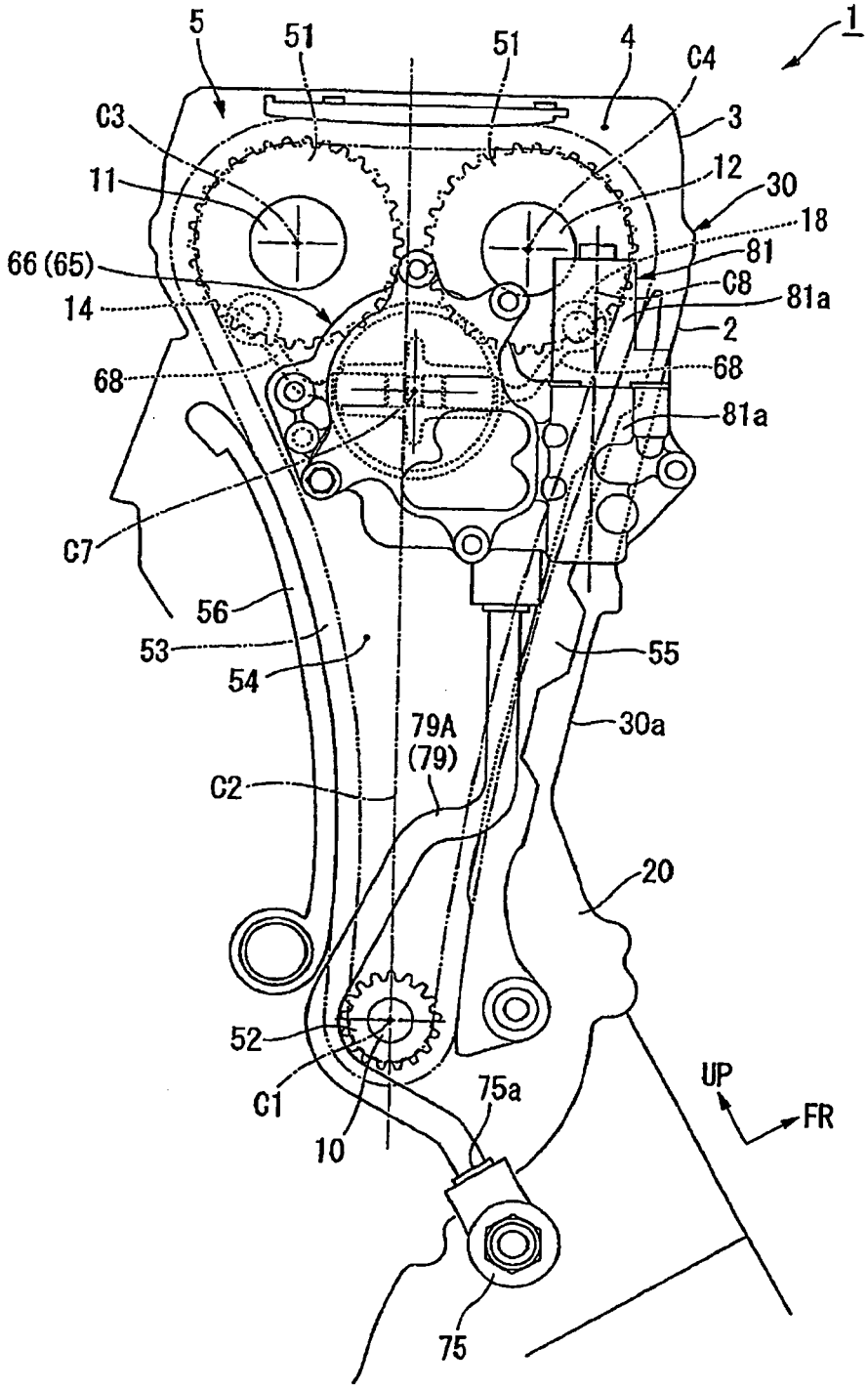
Figure 18:
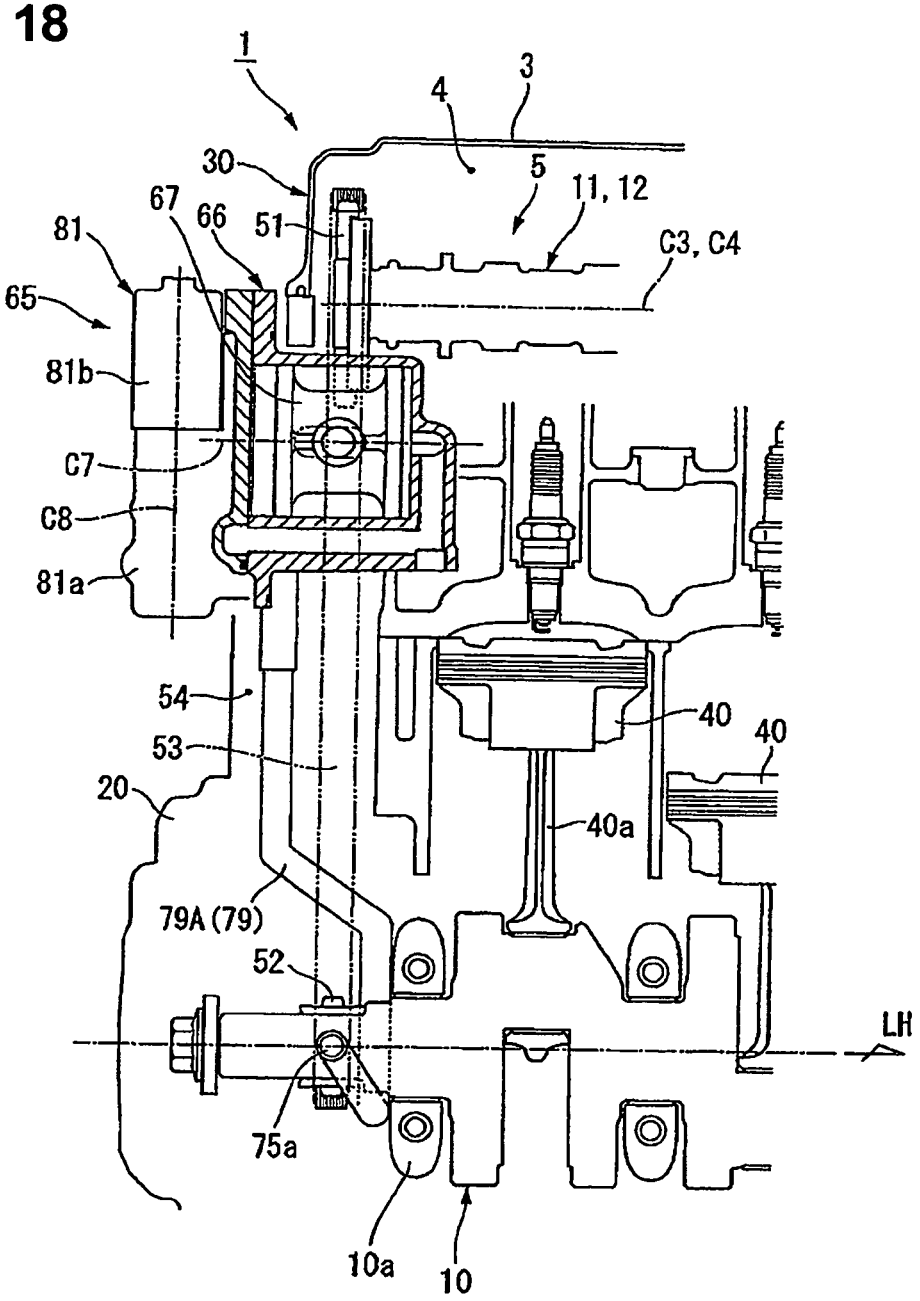
FIG. 18 is a plan-sectional view illustrating: the areas surrounding the cylinders seen from the front side; and the areas surrounding the crankshaft seen from below.
Figure 19:
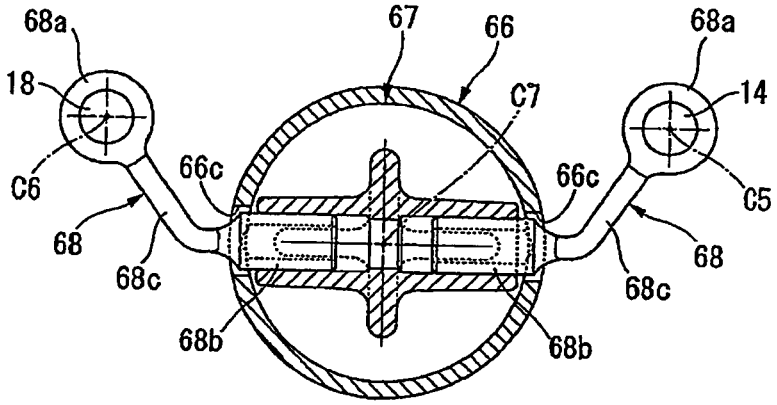
FIG. 19 is a sectional view of a hydraulic cylinder of the hydraulic actuator.

As shown in FIGS. 17 and 18, cam driven sprockets 51 each having a relatively large diameter are respectively fixed to the left-hand end portions of the camshafts 11 and 12 so as to be rotatable coaxially and together with their respective cam shafts 11 and 12. A cam drive sprocket 52 having a relatively small diameter is fixed to the left-hand end portion of the crankshaft 10 so as to be rotatable coaxially and together with the crankshaft 10. An endless cam chain 53 is wrapped around these three sprockets 51 and 52. The cam shafts 11 and 12 are linked with and driven by the crankshaft 10 by use of the sprockets 51 and 52 as well as the cam chain 53. To accommodate the cam chain 53 and the like, a cam-chain chamber 54 is formed inside the left-hand side portion of the cylinders 30.

Of the cam chain 53, the portion located at the front side of the cylinders 30 is the driving side (tension side) that is pulled in by the cam drive sprocket 52 while the portion located at the rear side of the cylinders 30 is the non-driving side (slack side) that is sent out from the cam drive sprocket 52. The cam chain 53 is wrapped around the sprockets 51 and 52 along a plane that is orthogonal to the right-and-left direction of this transversely-mounted engine 1.

A cam-chain guide 55 is fixedly provided in a front-side portion of the cam-chain chamber 54. The cam-chain guide 55 slidingly contacts the tension side of the cam chain 53 from its front side (i.e., from the outer-circumferential side), and guides the travelling direction of the tension side of the cam chain 53. A tensioner arm (cam-chain tensioner) 56 is provided in a rear-side portion of the cam-chain chamber 54. The tensioner arm 56 slidingly contacts the slack side of the cam chain 53 from its rear side (i.e., from the outer-circumferential side). The tensioner arm 56 thus guides the travelling direction of the slack side of the cam chain 53, and gives an appropriate tension to this side of the cam chain 53 (consequently, the slack of the cam chain 53 can be removed). An unillustrated lifter is provided to press the tensioner arm 56 onto the cam chain 53.

The valve mechanism 5 is configured as a variable valve control system that is capable of altering the timings at which the valves 6 and 7 are opened and closed and capable of altering the amount of lift for each of the valves 6 and 7 as well. While the engine is running slowly, for example, at an engine speed lower than 6000 rpm (revolutions per minute), the valve mechanism 5 opens and closes the valves 6 and 7 by means of the cams for low engine speeds formed on the corresponding cam shafts 11 and 12. On the other hand, while the engine is running fast, for example, at a high engine speed equal to or higher than 6000 rpm (revolutions per minute), the valve mechanism 5 opens and closes the valves 6 and 7 by means of the cams for high engine speeds formed on the corresponding cam shafts 11 and 12.

Now, the actions of the valve mechanism 5 are described by taking the intake side of one of the cylinders 30 as an example. Since the configurations of the intake sides of the other cylinders 30 and the configurations of the exhaust sides of the cylinders 30 are similar to the configuration of the example, descriptions thereof will be omitted.

Now, refer to FIG. 3. The cams 11A of the cam shaft 11 includes: a left and a right first cams 15*a* and 16*a* for low engine speeds; and a left and a right second cams 15*b* and 16*b* for high engine speeds. In brief, a total of four cams—the left and the right first cams 15*a* and 16*a* as well as the left and the right second cams 15*b* and 16*b*—are formed on the cam shaft 11 for each cylinder 30.

The shape of the left first cam 15*a* is identical to that of the right first cam 16*a* while the shape of the left second cam 15*b* is identical to that of the right second cam 16*b*. The left first cam 15*a* and the left second cam 15*b* are placed on the left-hand side of the cylinder and are adjacent to each other in the left-and-right direction of the transversely-mounted engine 1 (in the cam-shaft direction). The right first cam 16*a* and the right second cam 16*b* are placed on the right-hand side of the cylinder and are adjacent to each other in the left-and-right direction of the transversely-mounted engine 1 (in the cam-shaft direction).

The rocker arm 13 is supported by the rocker-arm shaft 14 swingably about the axis of the rocker-arm shaft 14 (i.e., about the rocker axis C5; hereafter also referred to as "about the axis C5") and of moving in the axial direction of the rocker-arm shaft 14 (i.e., in the direction along the rocker axis C5; hereafter also referred to as "in the direction of the axis C5"). The rocker arm 13 is an integrally-formed member that is so wide in the right-and-left direction of the transversely-mounted engine 1 as to cover both of the right and the left intake valves 6. The rocker arm 13 has a right-and-left pair of the slidingly-contact portions 13*c* that are formed separately from each other in the right-and-left direction of the transversely-mounted engine 1. The rocker arm 13 has a right-and-left pair of the valve pressing portions 13*d* that are formed, similarly, separately from each other in the right-and-left direction of the transversely-mounted engine 1.

Figure 3A:
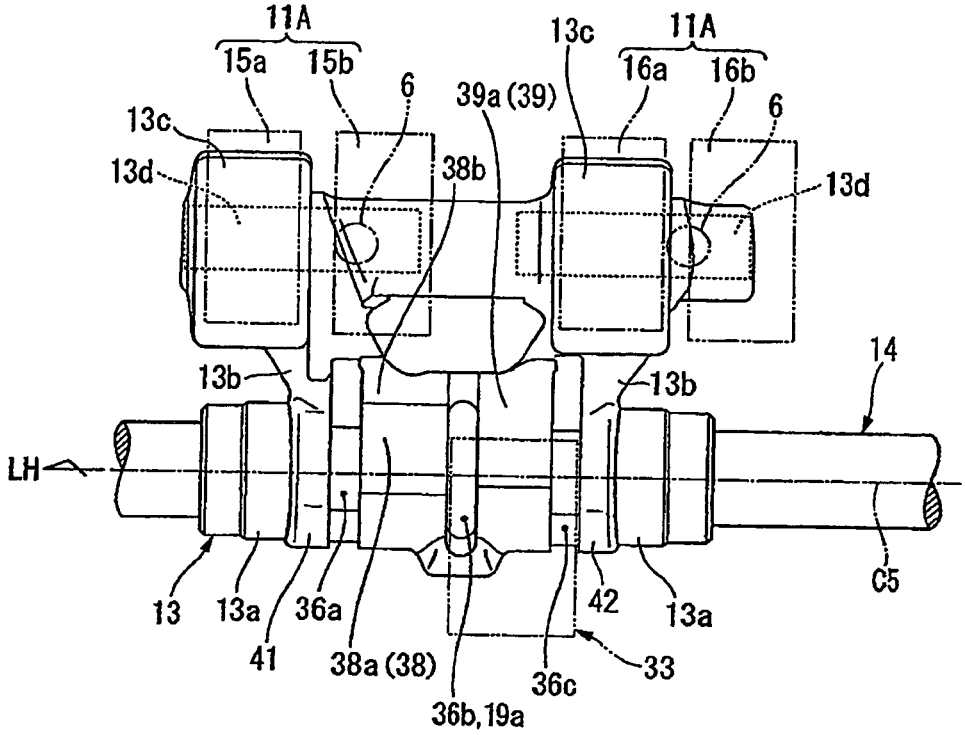
FIG. 3A is a plan view illustrating a first operation position for an intake-side rocker arm of the engine.

While the engine 1 is not in operation or is running at a low speed, the rocker arm 13 is located at the leftmost position in the direction of the axis C5, that is, at the limit for the leftward movement of the rocker arm 13 (see FIG. 3A). In this state, the left and the right cam slidingly-contact portions 13*c* are located respectively under the left and the right first cams 15*a* and 16*a* at such positions that the left and the right cam slidingly-contact portions 13*c* can slidingly contact the outer-circumferential surfaces (cam surfaces) of the left and the right first cams 15*a* and 16*a* respectively.

Each of the right and the left valve pressing portions 13*d* of the rocker arm 13 is formed wider, in the right-and-left direction (in the direction of the axis C5) than the corresponding one of the right and the left cam slidingly-contact portions 13*c*. When the rocker arm 13 is positioned in the above-mentioned limit for the leftward movement, the right and the left valve pressing portions 13*d* are located at such positions that the right-hand side portions of the right and the left valve pressing portions 13*d* can respectively press the leading-end portions of the stems 6*b* of the right and the left intake valves 6. The position, in the direction of the axis C5, of the rocker arm 13 at this time is referred to as a first operation position.

Figure 3B:
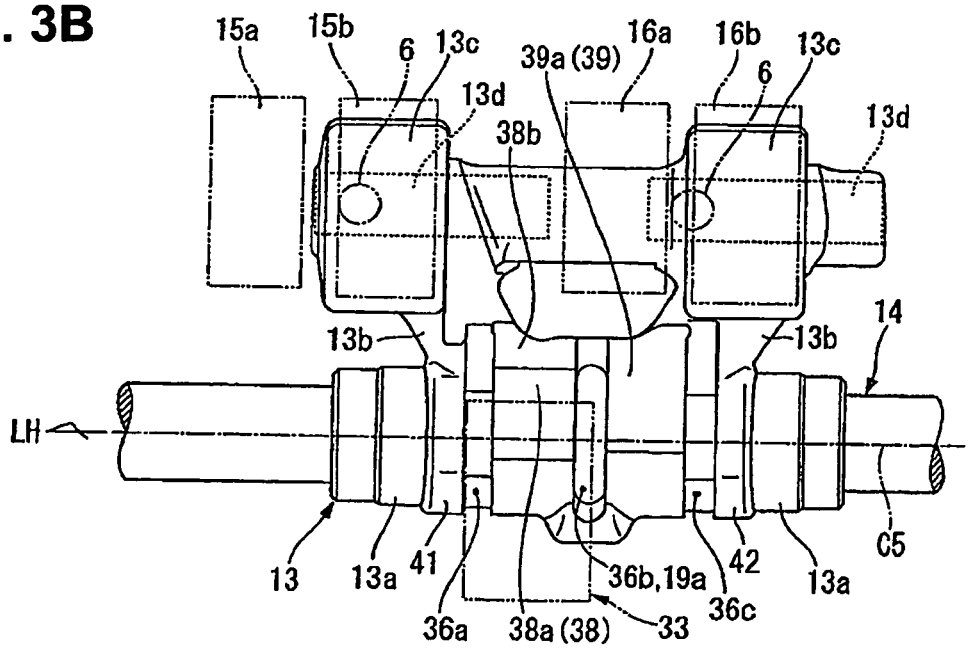
FIG. 3B is a plan view illustrating a second operation position of the rocker arm.

In contrast, while the engine 1 is running at a high speed, the rocker arm 13 is located at the rightmost position in the direction of the axis C5, that is, at the limit for the rightward movement of the rocker arm 13 (see FIG. 3B). In this state, the left and the right cam slidingly-contact portions 13*c* are located respectively under the left and the right second cams 15*b* and 16*b* at such positions that the left and the right cam slidingly-contact portions 13*c* can slidingly contact the outer-circumferential surfaces (cam surfaces) of the left and the right second cams 15*b* and 16*b* respectively.

When the rocker arm 13 is positioned in the above-mentioned limit for the rightward movement, the right and the left valve pressing portions 13*d* of the rocker arm 13 are located at such positions that the left-hand side portions of the right and the left valve pressing portions 13*d* can respectively press the leading-end portions of the stems 6*b* of the right and the left intake valves 6. The position, in the direction of the axis C5, of the rocker arm 13 at this time is referred to as a second operation position.

When the rocker arm 13 is at the first operation position, the rocker arm 13 swings in accordance with the cam profiles of the left and the right first cams 15*a* and 16*a*, and thus opens and closes the intake valves 6. In contrast, when the rocker arm 13 is at the second operation position, the rocker arm 13 swings in accordance with the cam profiles of the left and the right second cams 15*b* and 16*b*, and thus opens and closes the intake valves 6.

Now, refer also to FIG. 2. Each of the first and the second cams 15*a*, 16*a*, 15*b*, and 16*b* includes: a cylindrical base face F1 with the cam axis C3 being the center thereof; and a lift face F2 that protrudes at a predetermined position in the rotational direction radially outwards, like a hill, from the circle of the base face F1. Each of the left and the right first cams 15*a* and 16*a* has a smaller protruding amount (lift amount) of the lift face F2 than that of each of the left and the right second cams 15*b* and 16*b*. While the base face F1 of each of the cams 15*a*, 16*a*, 15*b*, and 16*b* is being opposed to and is slidingly in contact with the corresponding cam slidingly-contact portion 13*c* of the rocker arm 13, the corresponding intake valve 6 is closed completely (i.e., the lift amount is zero)—such a state is referred to as a valve-closed state. While the lift face F2 is being opposed to and is slidingly in contact with the corresponding cam slidingly-contact portion 13*c*, the corresponding intake valve 6 is opened against the biasing force of the valve spring 6*e* by a predetermined amount (i.e., the intake valve 6 is lifted by a predetermined amount)—such a state is referred to as a valve-opened state. Note that the lift amount of each of the first cams 15*a* and 16*a* may be zero (i.e., the first cams 15*a* and 16*b* may be designed as deactivating cams).

Figure 4:
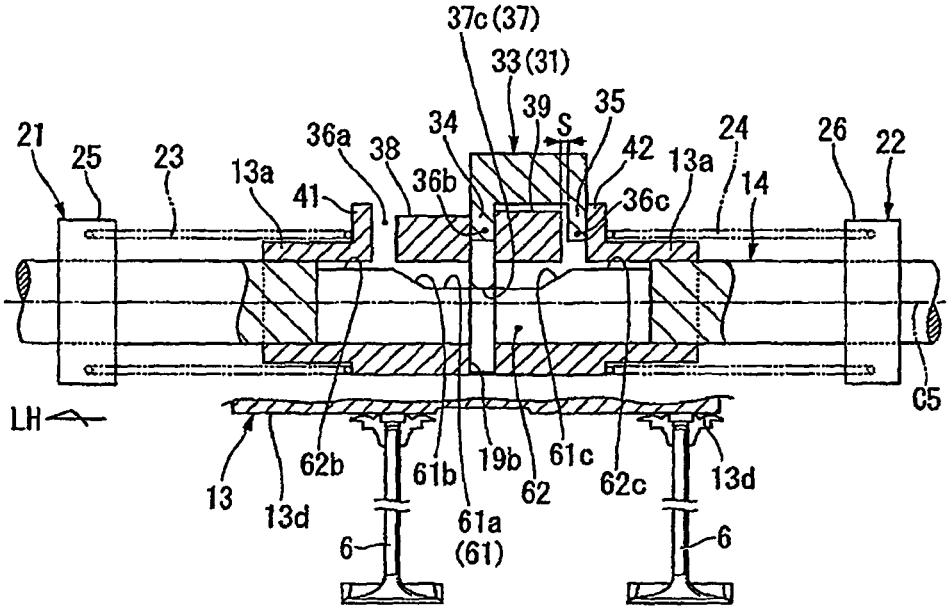
FIG. 4 is a sectional view taken along the axis of an intake-side rocker-arm shaft in the case where the rocker arm is located at the first operation position.

Now, refer to FIGS. 3 and 4. In order to open and close the intake valves 6, the valve mechanism 5 is capable of selectively using any set of the left and the right first cams 15*a* and 16*a*; and the left and the right second cams 15*b* and 16*b*. To this end, the valve mechanism 5 accumulates, in accordance with the engine speed, the force to make a first and a second rocker-arm moving mechanisms 21 and 22, which will be described in detail later, move the rocker arm 13 in the direction of the axis C5. The valve mechanism 5 uses the accumulated force to move the rocker arm 13 to either the first operation position or the second operation position.

The first rocker-arm moving mechanism 21 includes a first spring 23 and a first-spring receiving collar 25. The first spring 23 is positioned at the left-hand side of the left-hand portion of the shaft-insertion boss 13*a* of the rocker arm 13, and exerts the force on the left-hand end portion of the shaft-insertion boss 13*a* so as to move the rocker arm 13 from the side of the first operation position (i.e., the low-speed side) to the side of the second operation position (i.e., the high-speed side). The first-spring receiving collar 25 is positioned at the left-hand side of the first spring 23, and is fixedly supported by the outer circumference of the rocker-arm shaft 14.

Likewise, the second rocker-arm moving mechanism 22 includes a second spring 24 and a second-spring receiving collar 26. The second spring 24 is positioned at the right-hand side of the right-hand portion of the shaft-insertion boss 13*a* of the rocker arm 13, and exerts the force on the right-hand end portion of the shaft-insertion boss 13*a* so as to move the rocker arm 13 from the side of the second operation position to the side of the first operation position. The second-spring receiving collar 26 is positioned at the right-hand side of the second spring 24, and is fixedly supported by the outer circumference of the rocker-arm shaft 14.

Each of the springs 23 and 24 is a compression spring. The rocker-arm shaft 14 is inserted into the springs 23 and 24 so that the springs 23 and 24 can be wrapped around the rocker-arm shaft 14 along the outer circumference thereof. The right-hand end portion of the fist spring 23 is fitted to the outer circumference of the left-hand end portion of the shaft-insertion boss 13*a* of the rocker arm 13 while the left-hand end portion of the first spring 23 is fitted to the right-hand inner circumference of the first-spring receiving collar 25. On the other hand, the left-hand end portion of the second spring 24 is fitted to the outer circumference of the right-hand end portion of the shaft-insertion boss 13*a* of the rocker arm 13 while the right-hand end portion of the second spring 24 is fitted to the left-hand inner circumference of the second-spring receiving collar 26.

The rocker-arm shaft 14 is supported by the cylinder head 2 movably in its axial direction.

While the engine 1 is not in operation or is running as keeping a low engine-speed range (running at a low engine speed), the rocker-arm shaft 14 and the spring receiving collars 25 and 26 are positioned at their respective limits of leftward movement in the axial direction of the rocker-arm shaft 14. Here, the rocker-arm 13 is located at the first operation position (see FIG. 3A). The spring 23 that has been subjected to predetermined initial compression is provided between the spring receiving collar 25 and the corresponding portion of the shaft-insertion boss 13*a* of the rocker arm 13 while spring 24 that has been subjected to predetermined initial compression is compressively provided between the spring receiving collar 26 and the corresponding portion of the shaft-insertion boss 13*a* of the rocker arm 13.

While running as keeping a high engine-speed range (running at a high engine speed), the rocker-arm shaft 14 and the spring receiving collars 25 and 26 are positioned at their respective limits of rightward movement in the axial direction of the rocker-arm shaft 14. Here, the rocker-arm 13 is located at the second operation position (see FIG. 3B). As in the above-described case, the spring 23 that has been subjected to predetermined initial compression is provided between the spring receiving collar 25 and the corresponding portion of the shaft-insertion boss 13*a* of the rocker arm 13 while spring 24 that has been subjected to predetermined initial compression is compressively provided between the spring receiving collar 26 and the corresponding portion of the shaft-insertion boss 13*a* of the rocker arm 13.

The rocker arm 13 is moved from one of the operation positions to the other by a predetermined difference between the spring force of the spring 23 and that of the spring 24. The difference is caused by moving the rocker-arm shaft 14 and the spring receiving collars 25 and 26 together in the direction of the axis C5 relative to the cylinder head 2 while a movement-restriction mechanism 31, which will be described in detail later, restricts the movement of the rocker arm 13 in the direction of the axis C5.

Figure 7A:
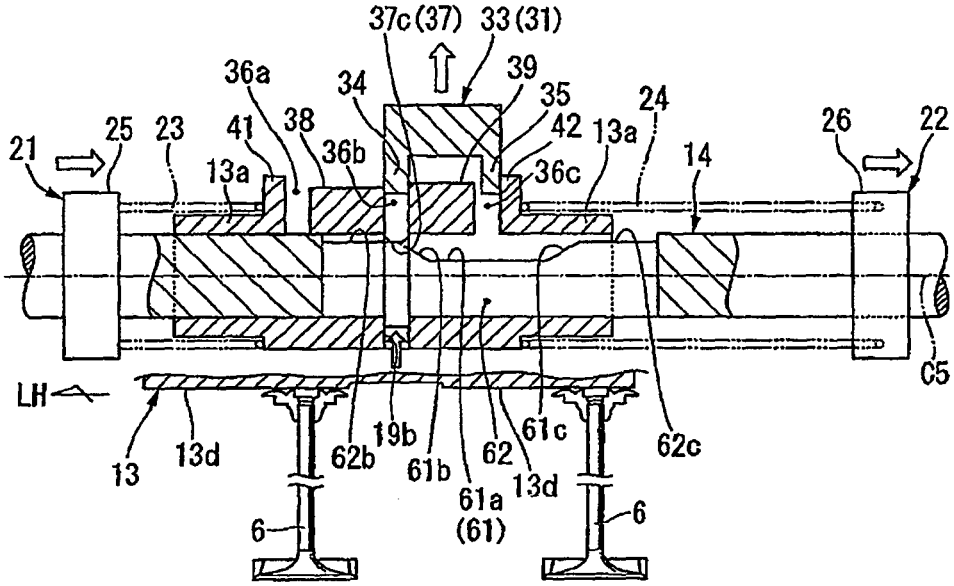
FIG. 7A is a sectional view corresponding to FIG. 4 but illustrating a state where the rocker-arm shaft moves in the axial direction from its position shown in FIG. 4 and a force needed for moving the rocker arm is accumulated.
Figure 12:
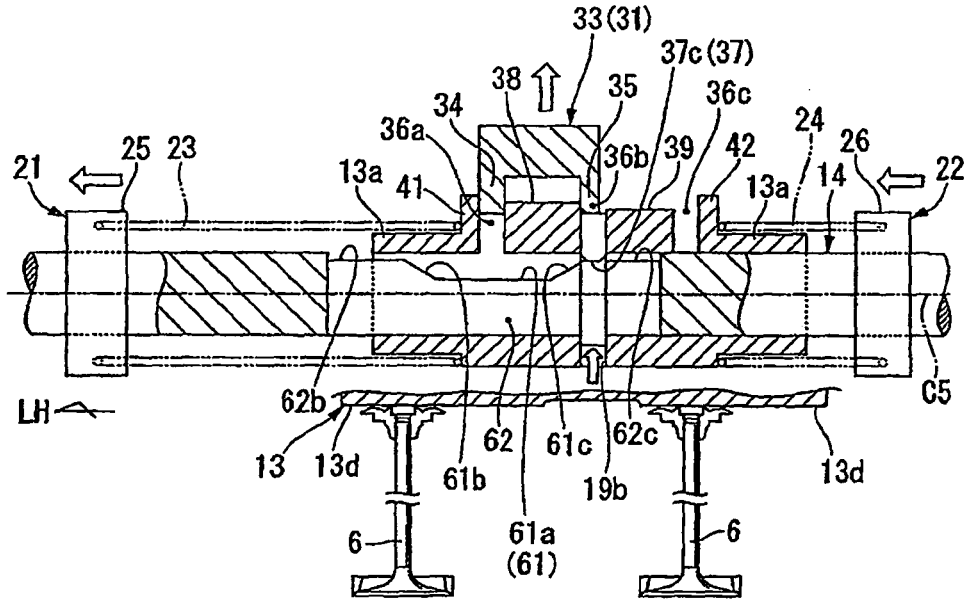
FIG. 12 is a sectional view corresponding to FIG. 11 but illustrating a state where the rocker-arm shaft moves in the axial direction from its position shown in FIG. 11 and a force needed for moving the rocker arm is accumulated.

Specifically, suppose a case where the rocker-arm shaft 14 and the spring receiving collars 25 and 26 together are moved rightwards, relative to the cylinder head 2, from their respective limits of leftward movement to their respective limits of rightward movement (see FIG. 7A). In this case, the first spring 23 is compressed further by the amount equivalent to the amount of the rightward movement, so that the spring force of the first spring 23 is increased. In addition, the second spring 24 is stretched, so that the spring force of the second spring 24 is decreased. Conversely, suppose a case where the rocker-arm shaft 14 and the spring receiving collars 25 and 26 together are moved leftwards, relative to the cylinder head 2, from their respective limits of rightward movement to their respective limits of leftward movement (see FIG. 12). In this case, the second spring 24 is compressed further by the amount equivalent to the amount of the leftward movement, so that the spring force of the second spring 24 is increased. In addition, the first spring 23 is stretched, so that the spring force of the first spring 23 is decreased.

The difference between the spring forces of the springs 23 and 24 (i.e., the spring force accumulated in either one of the springs 23 and 24) enables the rocker arm 13 to move from either one of the operation positions to the other.

Now, refer to FIGS. 3 to 6. The movement-restriction mechanism 31 is configured to restrict the movement of the rocker arm 13 in the direction of the axis C5 until either one of the springs 23 and 24 accumulates a predetermined spring force. The movement-restriction mechanism 31 includes: a trigger arm 33; three engagement grooves 36*a*, 36*b*, and 36*c*; a left-and-right pair of deck-like portions 38 and 39; and a trigger pin 37. The trigger arm 33 is supported by a support shaft 32 which extends in parallel with the rocker-arm shaft 2 and which is fixed to the cylinder head 2. The trigger arm 33 thus supported is allowed to swing about the axis of the support shaft 32, but is not allowed to move in the axial direction of the support shaft 32. The three engagement grooves 36*a*, 36*b*, and 36*c*, which are arranged in this order from left-hand side to the right-hand side, are formed in the shaft-insertion boss 13*a* of the rocker arm 13. A left- and right pair of engagement nails of the trigger arm 33 are selectively engaged with two of the three engagement grooves 36*a*, 36*b*, and 36*c*. The deck-like portion 38 is formed between the engagement grooves 36*a* and 36*b* while the deck-like portion 39 is formed between the engagement grooves 36*b* and 36*c*. The trigger pin 37 penetrates, from top to bottom, both the shaft-insertion boss 13*a* of the rocker arm 13 and the rocker-arm shaft 14 in a direction that is orthogonal to the direction of the axis C5 (in the direction orthogonal to the axis C5).

Now, refer to FIGS. 2 and 5. The support shaft 32 for the trigger arm 33 is provided above the rocker-arm shaft 14, and is located at a position offset towards the outer side of the cylinder (towards a side away from the cylinder axis C2).

Figure 6A:
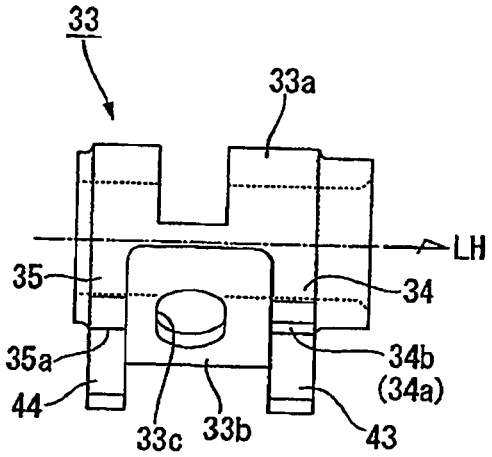
FIG. 6A is a front-side view of a trigger arm that restricts movement of the rocker arm between the operation positions.
Figure 6B:
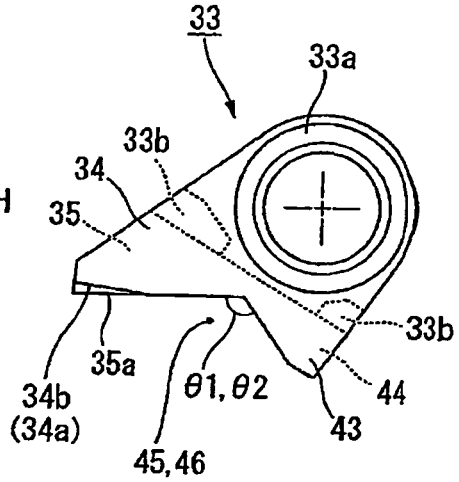
FIG. 6B is a left-side view of the trigger arm.

Now, refer to FIG. 6. The trigger arm 33 includes: a cylindrical base portion 33*a*; a left-hand and a right-hand engagement nails 34 and 35; and a connecting wall 33*b*. The support shaft 32 is inserted into the cylindrical base portion 33*a*. The engagement nails 34 and 35 extend from the base portion 33*a* towards the rocker-arm shaft 14. The connecting wall 33*b* connects the base-end side portion (i.e., the portion closer to the base portion 33*a*) of the left-hand engagement nail 34 to the base-end side portion of the right-hand engagement nail 35.

Each of the left-hand and the right-hand engagement nails 34 and 35 has a thick-plate shape, and extends orthogonally to the axial direction of the support shaft 32 (which is also the direction of the axis C5). When viewed in a direction along the direction of the axis C5 (i.e., when viewed in the direction of the axis C5), each of the engagement nails 34 and 35 has a triangular shape, and extends towards the vicinity of the upper-end portion of the shaft-insertion boss 13*a* of the rocker arm 13 (see FIG. 5).

The trigger arm 33 is biased towards a side, so that lower-edge portions 34*a* and 35*a* of the left-hand engagement nails 34 and 35 can be pressed, from above, onto the shaft-insertion boss 13*a* (i.e., biased counterclockwise in FIG. 5). When the rocker arm 13 is located at either one of the operation positions, the left-hand and the right-hand engagement nails 34 and 35 are put into the corresponding two of the three engagement grooves 36*a*, 36*b*, and 36*c* until the leading ends of the engagement nails 34 and 35 nearly reaches the bottoms of the corresponding grooves 36*a*, 36*b*, and 36*c*. This state of the trigger arm 33 is referred to as the pre-swing state of the trigger arm 33.

In this state, the sliding movement of the rocker arm 13 in the direction of the axis C5 is impossible. The rocker arm 13, however, is allowed to slide in the direction of the axis C5 when the trigger arm 33 swings towards the opposite side to the rocker arm 13 (i.e., swings so that the trigger arm 33 can move away from the rocker arm 13) thereby disengaging the left-hand and the right-hand engagement nails 34 and 35 from the corresponding ones of the engagement grooves 36*a*, 36*b*, and 36*c* (or with the corresponding one of the deck-like portions 38 and 39).

Now, refer to FIGS. 5 and 6. Each of the lower-edge portions 34*a* and 35*a* of the left-hand and the right-hand engagement nails 34 and 35 is formed as an end face that is parallel to the axial direction of the support shaft 32. When viewed in the direction of the axis C5, the shape of the lower-edge portion 34*a* differs from that of the lower-edge portion 35*a*. The deck-like portions 38 and 39 respectively have upper-end portions 38*a* and 39*a*, which are positioned in the vicinity of the upper-end of the shaft-insertion boss 13*a*. Each of the upper-end portions 38*a* and 39*a* is formed as an end face that is parallel to the direction of the axis C5. When viewed in the direction of the axis C5, the shape of the upper-end portion 38*a* differs from that of the upper-end portion 39*a*. The differences in shape between the engagement nails 34 and 35 as well as between the deck-like portions 38 and 39 result in different timings to disengage the engagement nails 34 and 35 from the engagement grooves 36*a*, 36*b*, and 36*c*.

Now, refer to FIGS. 3 and 4. The left-hand engagement nail 34 has a width in the direction of the axis C5 (i.e., the thickness of the engagement nail 34) is larger than that of the right-hand engagement nail 35. The widths of the engagement grooves 36*a*, 36*b*, and 36*c* in the direction of the axis C5 are large enough to allow the left-hand engagement nail 34 to engage with any one of these engagement grooves 36*a*, 36*b*, and 36*c* (i.e., the engagement grooves 36*a*, 36*b*, and 36*c* are formed as wide as the left-hand engagement nail 34).

Suppose a state where the left-hand engagement nail 34 engages with the central engagement groove 36*b* and the right-hand engagement nail 35 engages with the right-hand engagement groove 36*c* (i.e., the rocker arm 13 is located at the first operation position; see FIGS. 3A and 4). In this state, the right-hand sidewall of the right-hand engagement nail 35 gets closer to (almost contacts) the right-hand inner sidewall of the right-hand engagement groove 36*c*, and a predetermined gap S is left between the left-hand sidewall of the right-hand engagement nail 35 and the left-hand inner sidewall of the right-hand engagement groove 36*c*.

Figure 11:
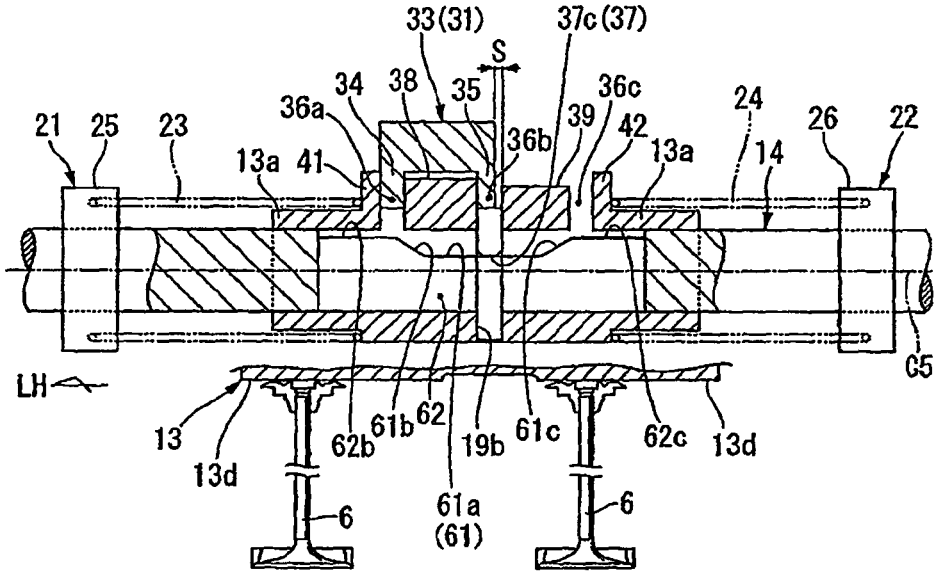
FIG. 11 is a sectional view taken along the axis of an intake-side rocker-arm shaft in the case where the rocker arm is located at the second operation position.

In contrast, suppose a state where the left-hand engagement nail 34 engages with the left-hand engagement groove 36*a* and the right-hand engagement nail 35 engages with the central engagement groove 36*b* (i.e., the rocker arm 13 is located at the second operation position; see FIGS. 3B and 11). In this state, the left-hand sidewall of the right-hand engagement nail 35 gets closer to (almost contacts) the left-hand inner sidewall of the central engagement groove 36*b*, and a predetermined gap S of the same amount as the above-mentioned one is left between the right-hand sidewall of the right-hand engagement nail 35 and the right-hand inner sidewall of the central engagement groove 36*b*.

Figure 7B:
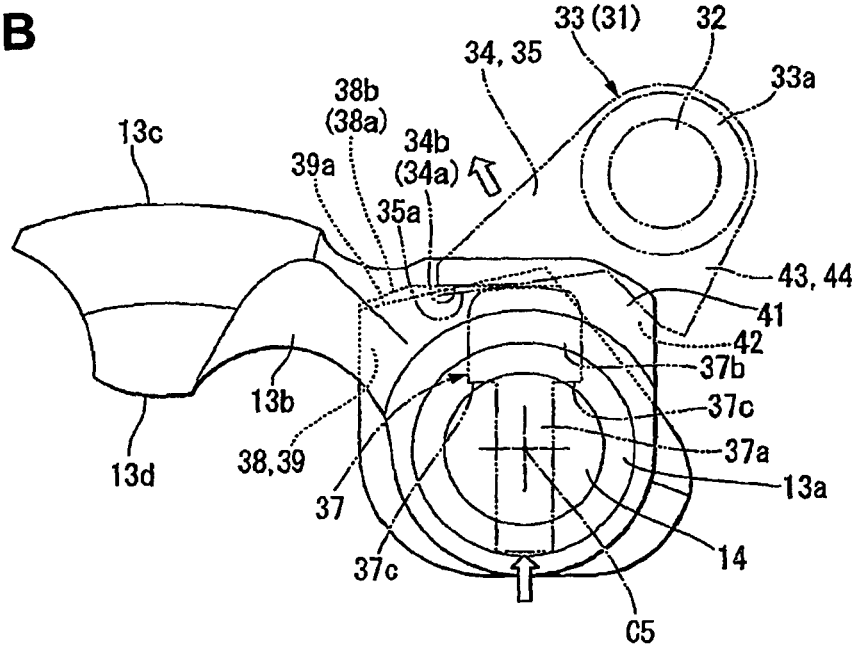
FIG. 7B is a left-side view corresponding to FIG. 5 but illustrating the state shown in FIG. 7A.

Now, refer to FIG. 7. When the axial-direction movement of the rocker-arm shaft 14 makes the trigger pin 37 act (detailed descriptions of the action of the trigger pin 37 will be given later), the trigger arm 33 comes to be in a state of primary swing state in which the trigger arm 33 swings from its position to the opposite side to the rocker arm 13 by a predetermined amount. The primary swing state is accomplished before the rocker arm 13 opens the valves 6. In this primary swing state, when viewed in the direction of the axis C5, the lower-edge portions 34*a* and 35*a* of the engagement nails 34 and 35 overlap the upper-end portions 38*a* and 39*a* of the deck-like portions 38 and 39 by predetermined amounts (i.e., the engagement nails 34 and 35 engage respectively with the corresponding ones of the engagement grooves 36*a*, 36*b*, and 36*c*). Such overlapping restricts the movement of the rocker arm 13 in the direction of the axis C5.

Figure 8:
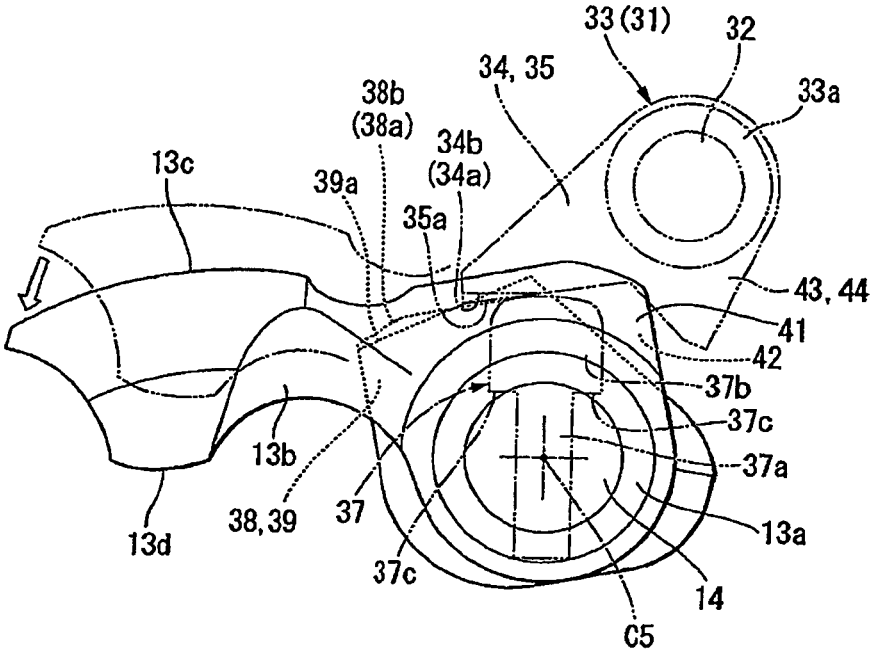
FIG. 8 is a left-side view corresponding to FIG. 5 but illustrating a state accomplished when the state of FIG. 7 is turned into another state where the rocker arm is turned to be in a valve opening state.
Figure 9A:
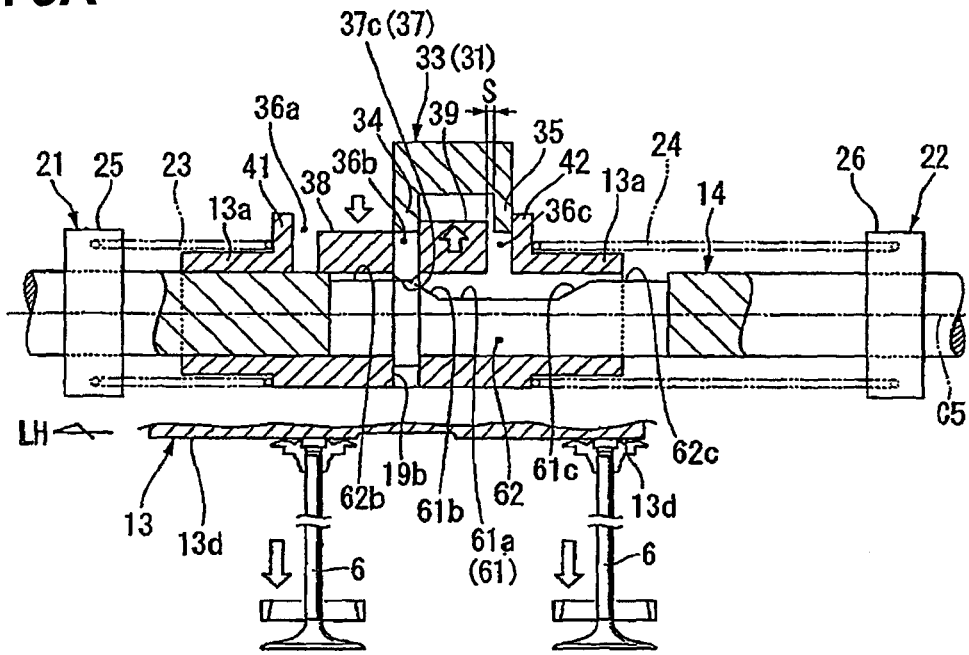
FIG. 9A is a sectional view corresponding to FIG. 4 but illustrating the state shown in FIG. 8.

Suppose that while the trigger arm 33 is in the primary swing state, the rocker arm 13 swings and lifts the valves 6 (see FIGS. 8 and 9A). The rotational movement of the shaft-insertion boss 13*a* along with the swing of the rocker arm 13 lowers down the upper-end portion 38*a* of the left-hand deck-like portion 38 that is adjacent to the left-hand engagement nail 34. Consequently, when viewed in the direction of the axis C5, the overlapping margin of the upper-end portion 38*a* and the lower-edge portion 34*a* of the left-hand engagement nail 34 disappears (i.e., the engagement nail 34 and the central engagement groove 36*b* are disengaged). In the meanwhile, the upper-end portion 39*a* of the right-hand deck-like portion 39 that is adjacent to the right-hand engagement nail 35 is raised up a little. This means that, when viewed in the direction of the axis C5, there still remains an overlapping margin of the right-hand engagement nail 35 and the right-hand deck-like portion 39 (i.e., the engagement of the engagement nail 35 and the right-hand engagement groove 36*c* is maintained).

Figure 9B:
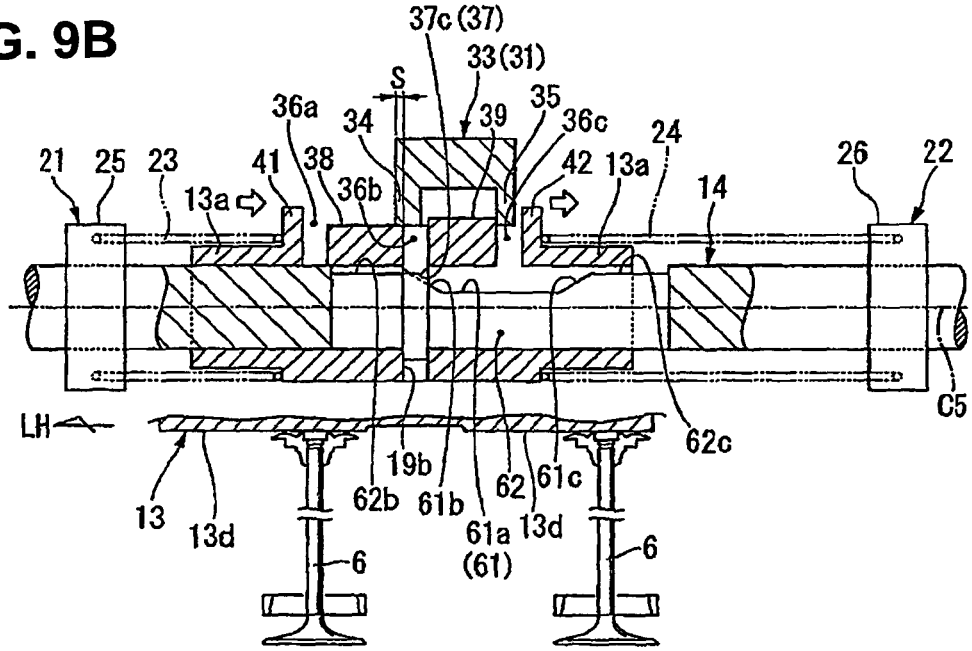
FIG. 9B is a sectional view corresponding to FIG. 4 but illustrating a state where the rocker arm moves in the axial direction by an amount equivalent to a gap S from its position shown in FIG. 9A.

In this state, a force that is given to the rocker arm 13 by either of the rocker-arm movement mechanisms 21 and 22 makes the rocker arm 13 slide by an amount equivalent to the gap S between the right-hand engagement nail 35 and either one of the right-hand and the central engagement grooves 36*c* and 36*b*. Consequently, the lower-edge portion 34*a* of the left-hand engagement nail 34 is surmounted on top of the upper-end portion 38*a* of the left-hand deck-like portion 38 by an amount equivalent to the gap S (see FIG. 9B).

Figure 10A:
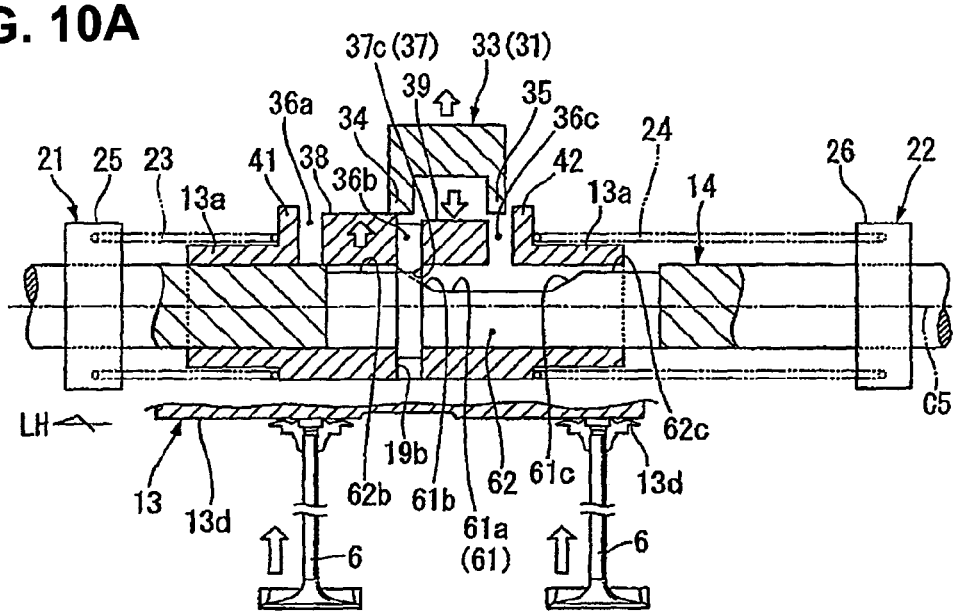
FIG. 10A is a sectional view corresponding to FIG. 4 but illustrating a state where the state of FIG. 9B is turned into another state where the rocker arm is turned to be in a valve closing state.
Figure 10B:
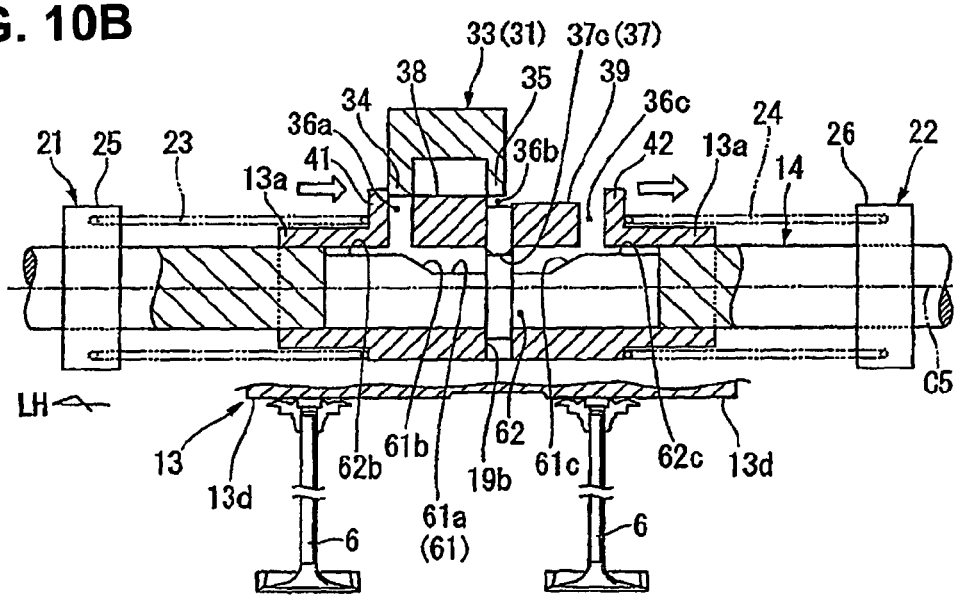
FIG. 10B is a sectional view corresponding to FIG. 4 but illustrating a state accomplished when the state of FIG. 10A is turned into another state where the rocker arm moves to the second operation position.

Then, in the above-described state, a swing of the rocker arm 13 to a side so as to close the valves 6 allows the upper-end portion 38*a* of the lowered-down left-hand deck-like portion 38 to be raised up and the raised-up upper-end portion 39*a* of the right-hand deck-like portion 39 is lowered down. Then, not only the left-hand engagement nail 34 but also the trigger arm 33 as a whole swings further to the opposite side to the rocker arm 13 (see FIG. 10A). Consequently, when viewed in the direction of the axis C5, the overlapping margin of the upper-end portion 39*a* of the right-hand deck-like portion 39 and the lower-edge portion 35*a* of the right-hand engagement nail 35 disappears (i.e., the engagement nail 35 and the right-hand engagement groove 36*c* are disengaged). Such disengagement allows the rocker arm 13 to slide from either one of the operation positions to the other (see FIG. 10B).

Now, refer to FIGS. 5 and 6. The lower-edge portions 34*a* and 35*a* of the left-hand and the right-hand engagement nails 34 and 35 of the trigger arm 33 are formed with their respective base-end sides (the sides closer to the base portion 33*a*) overlapping each other when viewed in the direction of the axis C5. The leading-end side of the lower-edge portion 35*a* of the right-hand engagement nail 35 is formed to be flat so that the leading-end side and the base-end side can form a single plane. The leading-end side of the lower-edge portion 34*a* of the left-hand engagement nail 34 is formed obliquely upwards so that the leading-end side is gradually narrowing down from the base-end side. An oblique face 34*b* is thus formed. At the timing when the engagement of the right-hand engagement nail 35 is disengaged from the right-hand deck-like portion 39, the oblique face 34*b* comes to be substantially parallel with and be brought into contact with a contact face 38*b* of the left-hand deck-like portion 38. Detailed descriptions of the contact face 38*b* will be given later.

Now, refer to FIGS. 4 and 5. When viewed in the direction of the axis C5, each of the left-hand and the right-hand deck-like portions 38 and 39 of the rocker arm 13 protrudes from the shaft-insertion boss 13*a* towards the base-end side of the arm portion 13*b* so as to form a substantially trapezoidal shape. When viewed in the direction of the axis C5, the upper-end portion 39*a* of the right-hand deck-like portion 39 is formed to be flat and extend in the direction of the tangential line to the shaft-insertion boss 13*a*.

When viewed in the direction of the axis C5, the upper-end portion 38*a* of the left-hand deck-like portion 38 is formed obliquely relative to the upper-end portion 39*a* of the right-hand deck-like portion 39. The protruding amount from the shaft-insertion boss 13*a* is gradually decreasing towards the side closer to the trigger arm 33, and is gradually increasing towards the side farther away from the trigger arm 33. Accordingly, the upper-end portions 38*a* and 39*a* of the left-hand and the right-hand deck-like portions 38 and 39 intersect each other when viewed in the direction of the axis C5.

In the upper-end portion 38*a* of the left-hand deck-like portion 38, the end portion farther away from the trigger arm 33 is cut away so as to be a chamfer when viewed in the direction of the axis C5. Accordingly, the end portion is obliquely shaped so that the farther a portion is located away from the trigger arm 33, the more the protruding amount from the shaft-insertion boss 13*a* is decreased. The entire upper-end portion 38*a* of the left-hand deck-like portion 38 is bent and is formed in a chevron shape when viewed in the direction of the axis C5.

The upper-end portion 38*a* of the left-hand deck-like portion 38 is formed as a mount face to be continuously in contact with the lower-edge portion 34*a* of the left-hand engagement nail 34 since the lower-edge portion 34*a* of the left-hand engagement nail 34 is surmounted on the upper-end portion 38*a*, until when the swing of the rocker arm 13 after the surmounting of the lower-edge portion 34*a* makes the left-hand engagement nail 34 (trigger arm 33) swing to the opposite side to the rocker arm 13 and the swing of the left-hand engagement nail 34 (trigger arm 33) disengages the right-hand engagement nail 35 from the right-hand deck-like portion 39.

In the upper-end portion 38*a* of the left-hand deck-like portion 38, the side closer to the trigger arm 33 is formed as a relatively-large flat portion (commonly-used portion). This larger flat portion is the place to be continuously in contact with the lower-edge portion 34*a* of the left-hand engagement nail 34 since the lower-edge portion 34*a* of the left-hand engagement nail 34 is surmounted on top of the left-hand deck-like portion 34 until the left-hand engagement nail 34 (trigger arm) swings to the opposite side to the rocker arm 13 so as to disengage the right-hand engagement nail 35 from the right-hand deck-like portion 39.

In addition, in the upper-end portion 38*a* of the left-hand deck-like portion 38, the side farther away from the trigger arm 33 is formed as a relatively-small flat portion. At the timing when the right-hand engagement nail 35 is disengaged from the right-hand deck-like portion 39, this smaller flat portion serves as the contact face 38*b* that, when viewed in the direction of the axis C5, is substantially parallel with and is brought into contact with the leading-end side (the oblique face 34*b*) of the lower-edge portion 34*a* of the left-hand engagement nail 34. Accordingly, fine adjustment of the timing when the right-hand engagement nail 35 is completely disengaged from the right-hand deck-like portion 39 (and even the cam-switching timing) requires only the changing of the height or the like of this relatively-small contact face 38*b*.

Now, refer to FIGS. 3, 4, and 5. A left-hand position-restriction portion 41 and a right-hand position-restriction portion 42 are formed respectively in a left-hand portion and in a right-hand portion of the shaft-insertion boss 13*a* of the rocker arm 13. When the trigger arm 33 is disengaged, either one of the left-hand and the right-hand position-restriction portions 41 and 42 is brought into contact with the trigger arm 33 so as to restrict the sliding movement of the rocker arm 13 within a predetermined distance.

Each of the left-hand and the right-hand position-restriction portions 41 and 42 extents orthogonally to the direction of the axis C5, and has a thick-plate shape. When viewed in the direction of the axis C5, each of the left-hand and the right-hand position-restriction portions 41 and 42 protrudes upwards from the shaft-insertion boss 13*a* so as to form a rectangular shape. Each of the left-hand and the right-hand position-restriction portions 41 and 42 protrudes at a position, in the circumferential direction of the shaft-insertion boss 13*a*, that is a little closer to the trigger arm 33 than the position of the left-hand and the right-hand deck-like portions 38 and 39. When viewed in the direction of the axis C5, the left-hand position-restriction portion 41 has a shape that is identical to the shape of the right-hand position-restriction portion 42. In addition, when viewed in the direction of the axis C5, the position-restriction portions 41 and 42 are larger than the left-hand and the right-hand deck-like portions 38 and 39. The left-hand position-restriction portion 41 is formed by extending upwards the left-hand inner sidewall of the left-hand engagement groove 36*a* so as to form a single plane. The right-hand position-restriction portion 42 is formed by extending upwards the right-hand inner sidewall of the right-hand engagement groove 36*c* so as to form a single plane.

Now, refer to FIG. 4. While the rocker arm 13 is located at the first operation position, the right-hand sidewall of the trigger arm 33 (i.e., the right-hand sidewall of the right-hand engagement nail 35) nearly contacts the right-hand inner sidewall of the right-hand engagement groove 36*c* (and the right-hand sidewall of the right-hand position-restriction portion 42). In the meanwhile, the gap S is left between the left-hand inner sidewall of the right-hand engagement groove 36*c* and the left-hand sidewall of the right-hand engagement nail 35. In addition, the two sidewalls of the left-hand engagement nail 34 of the trigger arm 33 nearly contact the two inner sidewalls of the central engagement groove 36*b* respectively.

Now, refer to FIG. 11. While the rocker arm 13 is located at the second operation position, the left-hand sidewall of the trigger arm 33 (i.e., the left-hand sidewall of the left-hand engagement nail 34) nearly contacts the left-hand inner sidewall of the left-hand engagement groove 36*a* (and the left-hand sidewall of the left-hand position-restriction portion 41). In the meanwhile, the right-hand sidewall of the left-hand engagement nail 34 nearly contacts the right-hand inner sidewall of the left-hand engagement groove 36*a*. In addition, the gap S is left between the right-hand sidewall of the trigger arm 33 (i.e., the right-hand sidewall of the right-hand engagement nail 35) and the right-hand inner sidewall of the central engagement groove 36*b*. Moreover, the left-hand sidewall of the right-hand engagement nail 35 nearly contacts the left-hand inner sidewall of the central engagement groove 36*b*.

Now, refer to FIGS. 5 and 6. A left-hand and a right-hand protruding pieces 43 and 44 are formed in the trigger arm 33. Like the left-hand and the right-hand engagement nails 34 and 35, the left-hand and the right-hand protruding pieces 43 and 44 are brought into contact respectively with the left-hand and the right-hand position-restriction portions 41 and 42, but are formed as separate bodies respectively from the left-hand and the right-hand engagement nails 34 and 35.

The left-hand and the right-hand protruding pieces 43 and 44 are positioned below the left-hand and the right-hand engagement nails 34 and 35, and extend from the base portion 33*a* of towards the rocker-arm shaft 14 so that, when viewed in the direction of the axis C5, the set of the left-hand and the right-hand protruding pieces 43 and 44 and the set of the left-hand and the right-hand engagement nails 34 and 35 can form a V-shape. Both the left-hand and the right-hand protruding pieces 43 and 44 have thick-plate shapes. The left-hand protruding piece 43 and the left-hand engagement nail 34 together form a single plane while the right-hand protruding piece 44 and the right-hand engagement nail 35 together form a single plane. When viewed in the direction of the axis C5, each of the left-hand and the right-hand protruding pieces 43 and 44 has a triangular shape of a protruding amount that is smaller than the protruding amount of each of the left-hand and the right-hand engagement nails 34 and 35. In addition, when viewed in the direction of the axis C5, the left-hand protruding piece 43 has an identical shape to that of the right-hand protruding piece 44.

The base-end side (the side closer to the base portion 33*a*) of the left-hand protruding piece 43 and that of the left-hand engagement nail 34 are contiguously formed while the base-end side of the right-hand protruding piece 44 and that of the right-hand engagement nail 35 are also contiguously formed. A cut-away portion 45 is formed between the left-hand protruding piece 43 and the left-hand engagement nail 34. In addition, a cut-away portion 46 is formed between the right-hand protruding piece 44 and the right-hand engagement nail 35. When viewed in the direction of the axis C5, each of the cut-away portions 45 and 46 is recessed so as to form a chevron shape (V-shape) while the side facing the rocker-arm shaft 14 of each of the cut-away portions 45 and 46 is the open side. To put it differently, the left-hand protruding piece 43 and the left-hand engagement nail 34 are formed respectively on the two sides of the cutaway portion 45 by forming the cut-away portion 45 in the middle section of a single plate-shaped member. Likewise, the right-hand protruding piece 44 and the right-hand engagement nail 35 are formed respectively on the two sides of the cutaway portion 46 by forming the cut-away portion 46 in the middle section of a single plate-shaped member.

When viewed in the direction of the axis C5, the protruding pieces 43 and 44 have identical shapes and the cut-away portions 45 and 46 have identical shapes. In addition, when viewed in the direction of the axis C5, the vertex angles of the cut-away portions 45 and 46 (denoted by θ1 and θ2, respectively) are obtuse angles. The connecting wall 33*b*, which has a thick plate shape, is formed, in parallel with the direction of the axis C5, in the vicinities of the vertices θ1 and θ2 to connect the left-hand and the right-hand engagements nails 34 and 35 as well as to connect the left-hand and the right-hand protruding pieces 43 and 44. A hole 33*c* is formed in a central portion of the connecting wall 33*b* by removing, when the trigger arm 33 is formed, the wall that is not of practical use. The formation of the hole 33*c* enables the trigger arm 33 to have a lighter weight.

Figure 15:
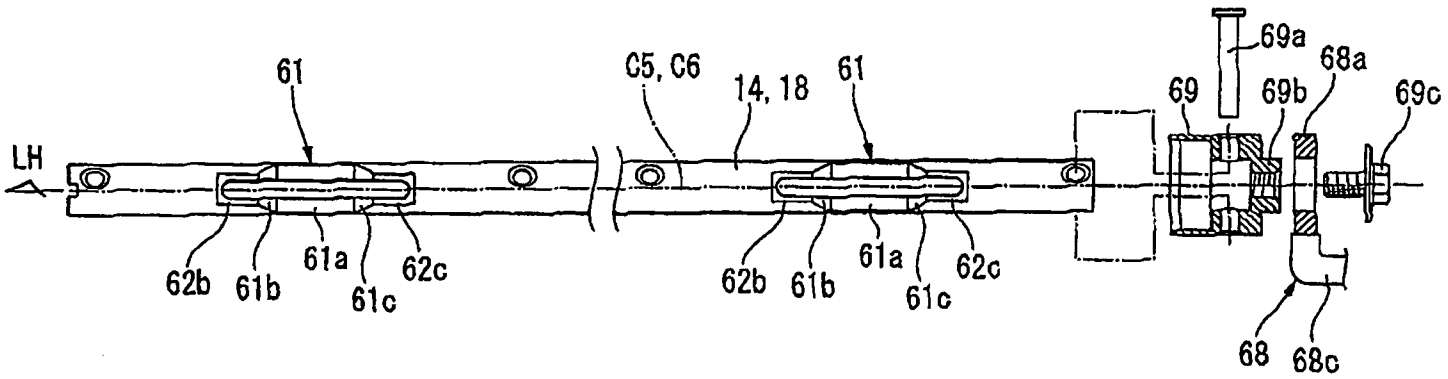
FIG. 15 is an exploded plan view illustrating the rocker-arm shaft and its surrounding areas.
Figure 16:
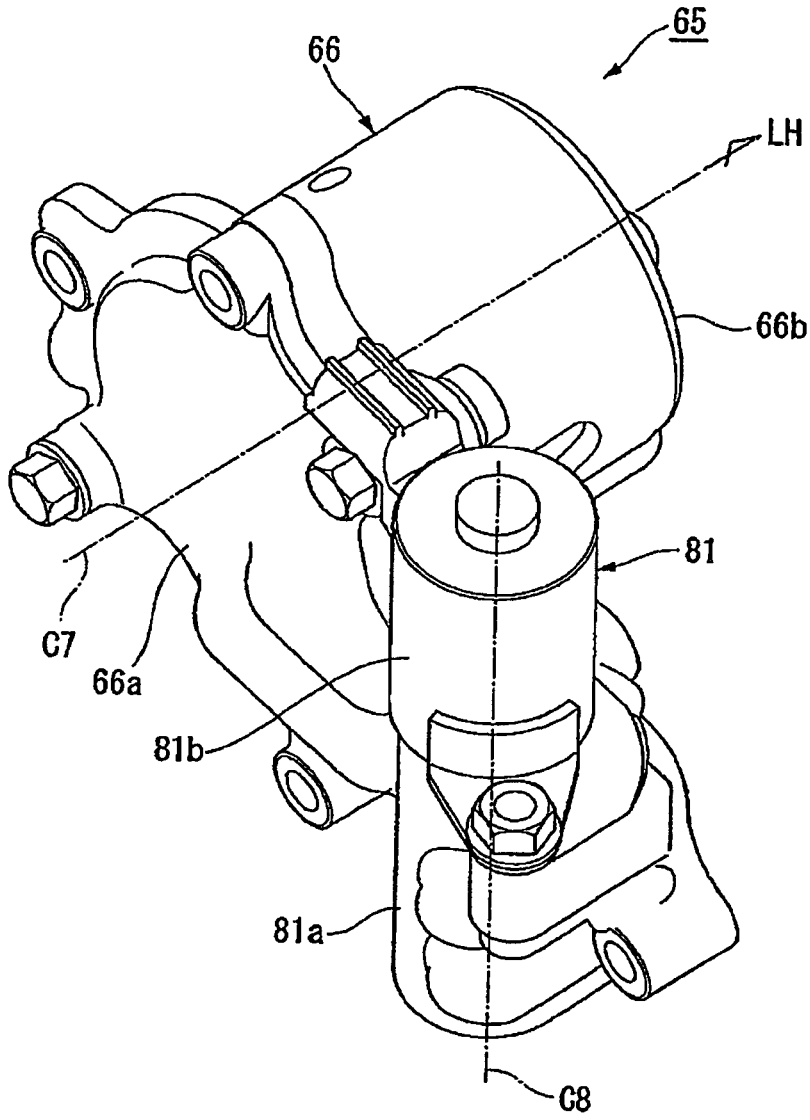
FIG. 16 is a perspective view illustrating a hydraulic actuator that moves the rocker-arm shaft in the axial direction.

Now, refer to FIGS. 4 and 15. Once the rocker-arm shaft 14 has been inserted into the shaft-insertion boss 13*a* of the rocker arm 13, a portion of the rocker-arm shaft 14 stays inside the shaft-insertion boss 13*a*. A cut-away recessed portion 61 is formed in the outer circumference on the upper side of the above-mentioned portion inside the shaft-insertion boss 13*a*. The cut-away recessed portion 61 extends in the direction of the axis C5 over a predetermined distance. The cut-away recessed portion 61 includes: a bottom face 61*a*; and a left-hand and a right-hand slopes 61*b* and 61*c*. The bottom face 61*a* is flat and parallel with the direction of the axis C5. The left-hand and the right-hand slopes 61*b* and 61*c* are respectively formed contiguously from the two ends, in the direction of the axis C5, of the bottom face 61*a*, and extend obliquely upwards relative to the bottom face 61*a*. The width (length), in the direction of the axis C5, of the bottom face 61*a* is larger than the width, in the direction of the axis C5, of each of the left-hand and the right-hand slopes 61*b* and 61*c*.

A long, slit-shaped through-hole 62 is formed in the rocker-arm shaft 14. The through-hole 62 extends in the direction of the axis C5, and penetrates, from top to bottom, the rocker-arm shaft 14 in a direction that is orthogonal to the axis C5. The through-hole 62 is formed at a position located substantially at the center of the width, in the direction orthogonal to the axis C5, of the cut-away recessed portion 61. The through-hole 62 is longer than the entire length, in the direction of the axis C5, of the cut-away recessed portion 61. A left-hand and a right-hand flat faces 62*b* and 62*c* are formed respectively at the outer sides, in the direction of the axis C5, of the cut-away recessed portion 61. The left-hand flat faces 62*b* and 62*c* extend, in parallel with the axis C5, contiguously from the left-hand slope 61*b* and the right-hand slope 61*c*, respectively. Each of the flat faces 62*b* and 62*c* covers the end portion, and also its surrounding area, of the through-hole 62 located at the outer side, in the direction of the axis C5, of the cut-away recessed portion 61.

The trigger pin 37 is inserted into the through-hole 62, and is held there.

Now, refer to FIGS. 4 and 5. The trigger pin 37 is a thick plate-shaped member that extends in a direction orthogonal to the direction of the axis C5. The width (thickness), in the direction of the axis C5, of the trigger pin 37 is approximately the same as that of each of the engagement grooves 36*a*, 36*b*, and 36*c* (which is also approximately the same as the thickness of the engagement nail 34). The trigger pin 37 includes an inserting portion 37*a* and a wider portion 37*b*. The inserting portion 37*a* has a strip shape, and is inserted into the through-hole 62 from above. The inserting portion 37*a* is held in the through-hole 62 so as to be movable in the direction of the axis C5, but not to be rotatable, relative to the through-hole 62, about the axis C5. The wider portion 37*b* is formed at the upper-end side of the inserting portion 37*a*. The width, in the direction orthogonal to the axis C5, of the wider portion 37*b* is extended both towards the front side and towards the rear side so as to make the wider portion 37*b* wider both than the inserting portion 37*a* and than the through-hole 62.

The top portion of the wider portion 37*b* has a curved arc shape when viewed in the direction of the axis C5. The wider portion 37*b* has a front-side and rear-side pair of bottom-side portions located at the two sides of the inserting portion 37*a*. The bottom-side portions extend straight along the direction orthogonal to the axis C5. The two bottom-side portions of the wider portion 37*b* are referred to as supported portions 37*c* because these portions are designed to be brought into contact, from above, with: the bottom face 61*a* of the cut-away recessed portion 61; the left-hand and the right-hand slopes 61*b* and 61*c* of the cut-away recessed portion 61; and the left-hand and the right-hand flat faces 62*b* and 62*c*. With the two supported portions 37*c*, the trigger pin 37 is supported by the rocker-arm shaft 14. The supported portions 37*c* prevents the trigger pin 37 from dropping downwards off the through-hole 62, but allows the trigger pin 37 to move upwards.

While the engine 1 is running at either a low speed or a high speed, the supported portions 37*c* of the trigger pin 37 are supported on top of a substantially central portion, in the direction of the axis C5, of the bottom face 61*a* of the cutaway recessed portion 61 (see FIGS. 4 and 11). At this time, the upper portion of the wider portion 37*b* and the lower portion of the inserting portion 37*a* protrude out to the outer-circumferential sides of the rocker-arm shaft 14.

An upper fitting hole 19*a* is formed in the bottom of the central engagement groove 36*b* formed in the shaft-insertion boss 13*a* of the rocker arm 13. The upper fitting hole 19*a* is capable of being inserted into and fitted to by the upper portion of the wider portion 37*b* (see FIG. 3). A lower fitting hole 19*b* is formed in a radially-opposite portion of the shaft-insertion boss 13*a* to the upper fitting hole 19*a*. The lower fitting hole 19*b* is capable of being inserted into and fitted to by the lower portion of the inserting portion 37*a* (see FIG. 4).

The upper portion and the lower portion of the trigger pin 37 are inserted into and fitted to the upper and the lower fitting holes 19*a* and 19*b*, respectively. Accordingly, the trigger pin 37 is movable, together with the rocker arm 13, in the direction of the axis C5 relative to the rocker-arm shaft 14. In addition, the trigger pin 37 is prevented from leaning, that is, displacing either its upper portion or its lower portion in the direction of the axis C5. The rotation of the trigger pin 37 about its own up-and-down direction axis is also prevented. Note that, if the width of each of the upper and the lower fitting holes 19*a* and 19*b* is formed to have a larger width in the front-to-rear direction, the trigger pin 37 and the rocker-arm shaft 14 are rotatable is C5 relative to each other.

Suppose a state in which the rocker arm 13 is located at either one of the two operation positions and the two supported portions 37*c* are supported on top of the substantially central portion of the bottom face 61*a*. In addition, suppose that, in this state, while the movement-restriction mechanism 31 restricts the movement, in the direction of the axis C5, of the rocker arm 13, a hydraulic actuator 65, which will be described later, makes the rocker-arm shaft 14 move in the direction of the axis C5. Then, the two supported portions 37*c* are surmounted on top of either one of the left-hand and the right-hand slopes 61*b* and 61*c* located at the two sides of the bottom face 61*a*. Thus the trigger arm 33 moves upwards in the orthogonal direction to the axis C5.

Either of the left-hand and the right-hand engagement nails 34 and 35 of the trigger arm 33 enters, from above, the central engagement groove 36*b*, and thus engages with the central engagement groove 36*b*. The lower-edge portions 34*a* and 35*a* are brought into contact with the top portion of the wider portion 37 of the trigger pin 37. In this state, a rise of the trigger pin 37 makes the trigger arm 33 swing by a predetermined amount to a side so as to disengage one of the engagement nails 34 and 35 from the central engagement groove 36*b*, and eventually with the rocker arm 13.

Now, refer to FIGS. 17 and 18. In the cylinder head 2, the hydraulic actuator 65 is provided in a right-hand side portion that the right-hand end portions of the rocker-arm shafts 14 and 18 are opposed to. The hydraulic actuator 65 is configured to move the rocker-arm shafts 14 and 18 in the direction of the axis C5.

The hydraulic actuator 65 includes a hydraulic cylinder 66, which is arranged with its axis being parallel with the axial direction of the rocker-arm shafts 14 and 18. The hydraulic cylinder 66 is disposed at a position between the rocker-arm shafts 14 and 18 so as to get across, in the right-and-left direction, the cam-chain chamber 54 located inside the right-hand side portion of the cylinder head 2. A plunger 67 is provided inside the hydraulic cylinder 66, and a front-and-rear pair of operation elements 68 extend respectively from the two side faces of the plunger 67. The operation elements 68 are made to engage respectively with the right-hand end portions of the rocker-arm shafts 14 and 18, and thus the rocker-arm shafts 14 and 18 are made to move simultaneously in the direction of the axis C5 by a stroke of the plunger 67.

Now, refer to FIG. 15. An end collar 69, which has a cylindrical shape with a bottom, is fixed to the right-hand end portion of each of the rocker-arm shafts 14 and 18 by means of a pin 69*a* that is inserted into the end collar 69 orthogonally to the direction of the axis C5. A protruding portion 69*b* is formed on the outer side of the bottom of each end collar 69. A ring portion 68*a* is formed in the leading-end portion of each operation element 68. The ring portions 68*a* of the operation elements 68 are fitted respectively to the protruding portions 69*b* of each end collar 69. Each of the ring portions 68*a* and the corresponding one of the protruding portions 69*b* thus fitted to each other are rotatable relative to each other. A flanged bolt 69*c* is fastened to the outer side of the protruding portion 69*b* of each end collar 69, so that the corresponding ring portion 68*a* is assembled to the end collar 69 (rocker-arm shaft 14 or 18) while not allowed to move in the direction of the axis C5. Note that each operation element 68 has only to be fixed to the end collar 69 by any means. For example, if, as in the above-described example, a fastening member is used, the ring portion 68*a* may be fitted to a male-threaded portion formed in the corresponding end collar 69, and fixed with a nut. Alternatively, each operation element 68 may be riveted to the corresponding end collar 69.

As in the case of the second-spring receiving collar 26, the right-hand end portion of the second spring 24 is fitted to the inner circumference of the left-hand side of the end collar 69. To put it differently, the end collar 69 functions also as the second-spring receiving collar 26 for the cylinder 30 located at the outermost right-hand side of all the cylinders 30 that the engine 1 has.

Figure 20:
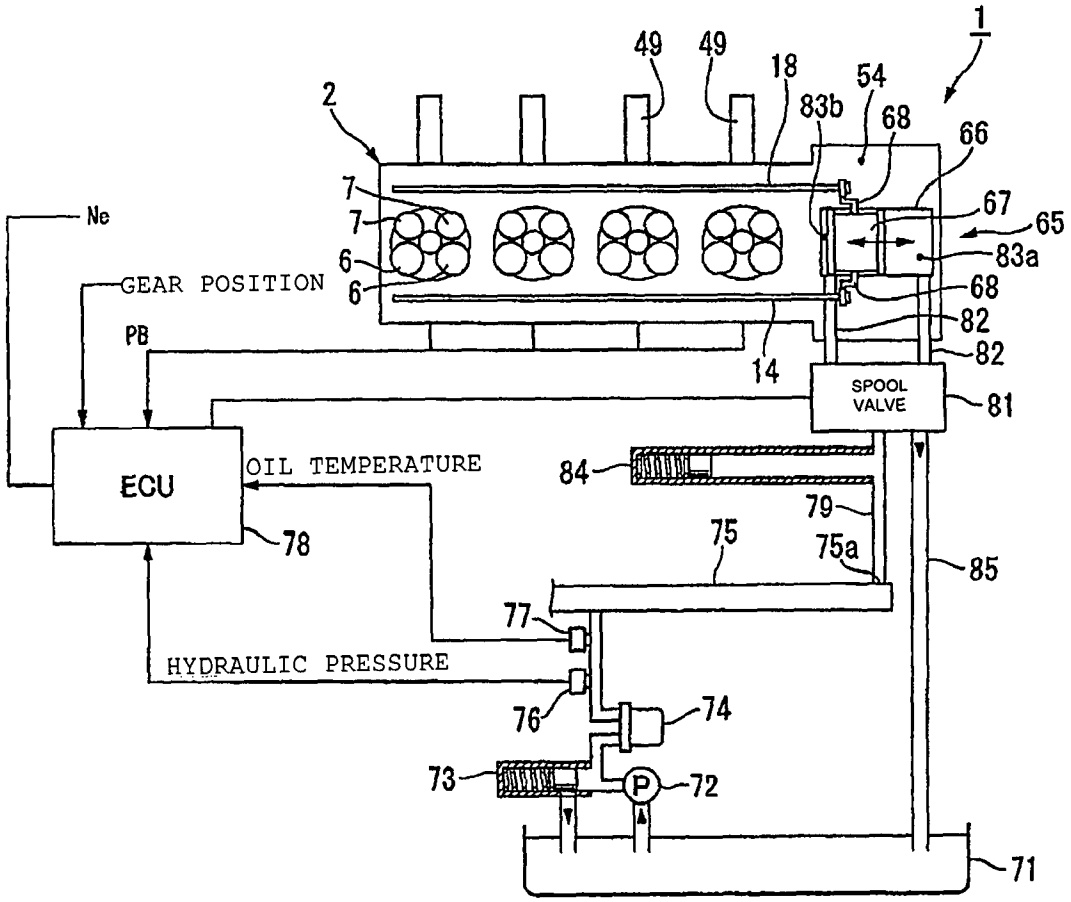
FIG. 20 is a diagram illustrating the configuration of a valve mechanism for the engine.

Now, refer to FIG. 20. An oil pump 72 is provided in a lower portion of the engine 1. The oil pump 72 pumps out the engine oil stored in an oil pan 71. Hydraulic pressure is supplied by the oil pump 72 to an oil gallery 75 through a relief valve 73 and an oil filter 74.

The oil gallery 75 that extends in the direction in which the cylinders 30 are arranged (i.e., in the vehicle-width direction) is disposed approximately right below the crankshaft 10 (that is, the oil gallery 75 extends in parallel with the crankshaft 10). The oil gallery 75 supplies the engine oil to the crankshaft bearing and the like in an appropriate manner. A hydraulic-pressure sensor 76 and an oil-temperature sensor 77 are provided in an oil passage connecting the oil pump 72 to the oil gallery 75. The signals detected by these sensors 76 and 77 are inputted into an ECU 78 that is configured to control the operation of the engine 1 as a whole. The information detected by the hydraulic-pressure sensor 76 is used for detecting the malfunction of the hydraulic-pressure supply system.

An oil supply hole 75*a* is formed in the right-hand end portion of the oil gallery 75. An oil channel 79 extends from the oil supply hole 75*a* to a spool valve 81 of the hydraulic actuator 65. The operation of the spool valve 81 is controlled by the ECU 78, and the spool valve 81 switches the hydraulic routes so as to switch, in accordance with the engine speed (Ne), the gear position or the like, the cams used for opening and closing the valves 6 and 7.

The spool valve 81 enables the hydraulic pressure from the oil channel 79 to be supplied, selectively via either one of two oil passages 82 to the corresponding one of oil chambers 83*a* and 83*b* that are located respectively on the two sides of the hydraulic cylinder 66. When hydraulic pressure is supplied from the oil pump 72, via this spool valve 81, selectively to either of the oil chambers 83*a* and 83*b* located on the two sides of the hydraulic cylinder 66, the plunger 67 gives a stroke so as to move the rocker-arm shafts 14 and 18 simultaneously in the axial direction.

Accordingly, each of the rocker-arm shafts 14 and 18 thus moves from one of the two limit positions for the leftward and the rightward movements to the other. Consequently, either one of the first and the second rocker-arm moving mechanisms 21 and 22 has a force that is large enough to make the rocker arm 13 slide from one of the operation positions to the other.

FIG. 20 also shows an accumulator 84 that is provided in the oil channel 79 and a hydraulic-pressure returning passage 85 extending from the spool valve 81. In addition, the negative pressure inside the intake pipe (PB) is detected for each of the cylinders 30 to detect operation failure, and the information thus obtained is inputted into the ECU 78.

Now, refer to FIGS. 16 to 19. The hydraulic actuator 65 includes: the hydraulic cylinder 66 that has a cylindrical shape with a bottom; the plunger 67 which is coaxially installed in the hydraulic cylinder 66 and which is capable of giving strokes; a plate-shaped cover 66*a* that is used for closing the opening side of the hydraulic cylinder 66; and the spool valve 81 that is provided integrally with a side of the cover 66*a*.

A flange is formed on the opening side of the hydraulic cylinder 66, and the outer-circumferential portion of the cover 66*a* is fixed, together with the flange of the hydraulic cylinder, to a right-hand side portion of the cylinder head 2 by means of bolts or the like. Accordingly, most of the hydraulic cylinder 66 is placed inside the cylinder head 2, resulting in a reduction in the amount by which the hydraulic cylinder 66 sticks out to the outside of the cylinder head 2 (outside of the engine 1).

The hydraulic cylinder 66 is placed so that its axial center (represented by an axis C7) can be close to the cylinder axis C2 when viewed from a side of the engine 1. The spool valve 81 has a cylindrical appearance that extends in the up-and-down direction. The spool valve 81 is placed so that the axial center of the spool valve 81 (represented by the axis C8) can be orthogonal to the axis C7 of the hydraulic cylinder 66 and can be substantially parallel with the cylinder axis C2.

The spool valve 81 includes a casing 81*a*. The casing 81, which forms the lower portion of the spool valve 81, is formed integrally with a side of the cover 66*a*. Inside the casing 81*a*, a plunger capable of switching hydraulic routes is installed so as to be allowed to give strokes. A solenoid 81*b* forms the upper portion of the spool valve 81, and makes the plunger give strokes to switch hydraulic routes.

When viewed from a side of the engine 1 (i.e., when viewed in the direction of the axis C7 of the hydraulic cylinder 66), the spool valve 81 is placed at the front side of the hydraulic cylinder 66 so as to avoid the hydraulic cylinder 66. Thus achieved is a reduction in the amount by which the spool valve 81 sticks out to the outside of the cylinder head 2 (outside of the engine 1).

Now, refer to FIG. 21. The plunger 67 includes disc-shaped seal members 67*a* and 67*b*, which are provided on the two sides (i.e., the side closer to the cover 66*a* and the side closer to a bottom portion 66*b*), in the direction of the axis C7, of the plunger 67. The seal members 67*a* and 67*b* slidingly contact the inner wall of the hydraulic cylinder 66. The oil chamber 83*a* is formed between the seal member 67*a* and the cover 66*a* of the hydraulic cylinder 66 while the oil chamber 83*b* is formed between the seal member 67*b* and the bottom portion 66*b*.

No oil chamber is formed in the middle section, in the direction of the axis C7, of the hydraulic cylinder 66 and of the plunger 67. In the middle section, ellipsoidal insertion holes 66*c* are formed in the two side portions, in the radial direction, of the hydraulic cylinder 66. Base portions 68*b* of the operation elements 68 are inserted through the insertion holes 66*c* from the outside of the hydraulic cylinder 66 into the inside thereof, and are attached respectively to the two sides, in the radial direction, of the plunger 67.

Each operation element 68 includes the base portion 68*b*, an arm portion 68*c*, and the ring portion 68*a*. The base portion 68*b* has a circular-shaft shape, and is inserted into either one of the two sides, in the radial direction, of the plunger 67. The arm portion 68*c* extends from the outer end of the base portion 68*b* and bends towards the bottom portion 66*b* of the hydraulic cylinder 66. The arm portion 68*c* then extends obliquely upwards to a side so as to be separated away from the hydraulic cylinder 66. The ring portion 68*a* is formed in the leading-end portion of the arm portion 68*c*.

When the engine 1 is mounted on the vehicle, the hydraulic cylinder 66 and the plunger 67 are placed so that their axial direction can be substantially horizontal. Air-purge grooves 86*a* and 86*b* are formed respectively in the outer circumferences of the upper portions of the seal members 67*a* and 67*b* of the plunger 67. While the plunger 67 is giving a stroke, the air-purge grooves 86*a* and 87*a* are used for purging the air inside the oil chambers 83*a* and 83*b* respectively.

When viewed from the top of the plunger 67, each of the air-purge grooves 86*a* and 86*b* is formed to have a Y-shape. A pair of air-purge holes 87*a* and 87*b* are drilled in upper portions of the hydraulic cylinder 66. The air-purge hole 87*a* is formed on the side closer to the cover 66*a*, and the air-purge hole 87*b* is formed on the side closer to the bottom portion 66*b*. The air-purge grooves 86*a* and 87*a* correspond respectively to the air-purge holes 87*a* and 87*b*.

Figure 21A:
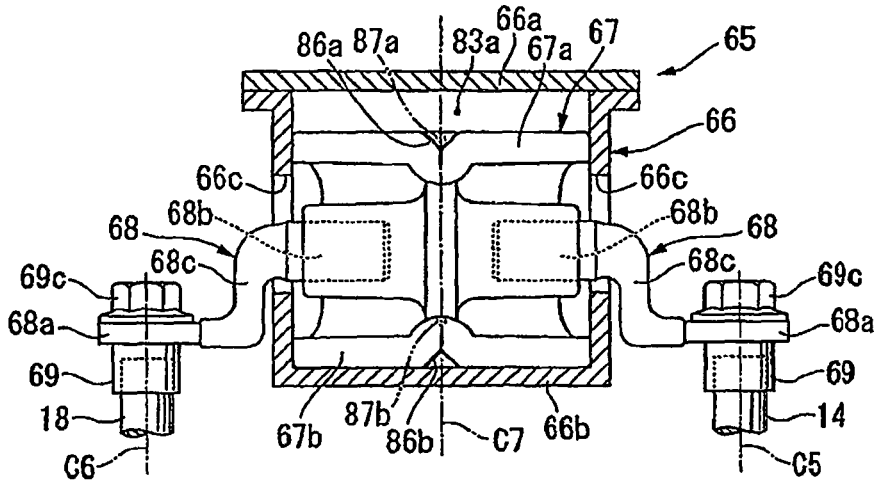
FIG. 21A illustrates, the air purging of the hydraulic cylinder, a state where the plunger has given a complete stroke.
Figure 21B:
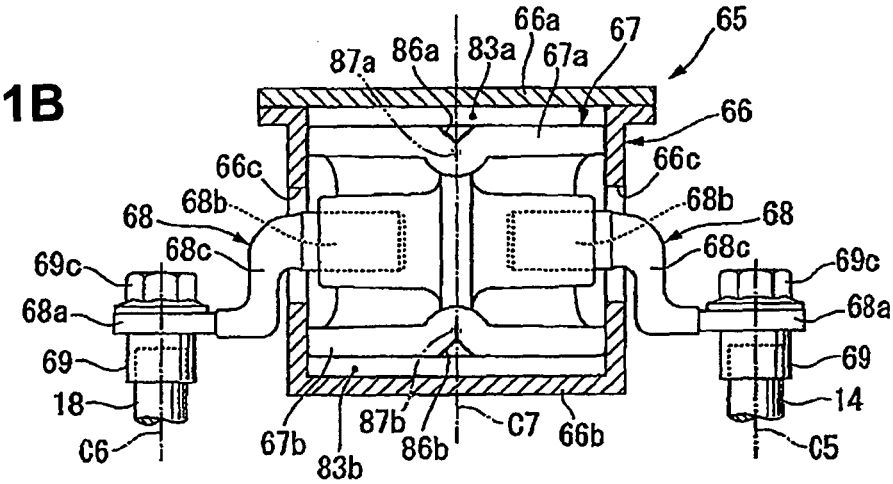
FIG. 21B illustrates, the air purging of the hydraulic cylinder, a state where the plunger is in the course of giving a stroke.

Suppose, for example, that the plunger 67 has given a complete stroke towards the bottom portion 66*b* of the hydraulic cylinder 66 (see FIG. 21A). In this state, the air-purge hole 87*b* on the side closer to the bottom portion 66*b* is located at a position offset towards the cover 66*a* from the single leg portion of the air-purge groove 86*b* on the same side, that is, on the side closer to the bottom portion 66*b*. The air-purge hole 87*a* on the side closer to the cover 66*a* is positioned between the branched arm portions of the air-purge groove 86*a* on the same side, that is, on the side closer to the cover 66*a*. Each of the oil chambers 83*a* and 83*b* is thus kept in an oil-tight state.

Figure 21C:
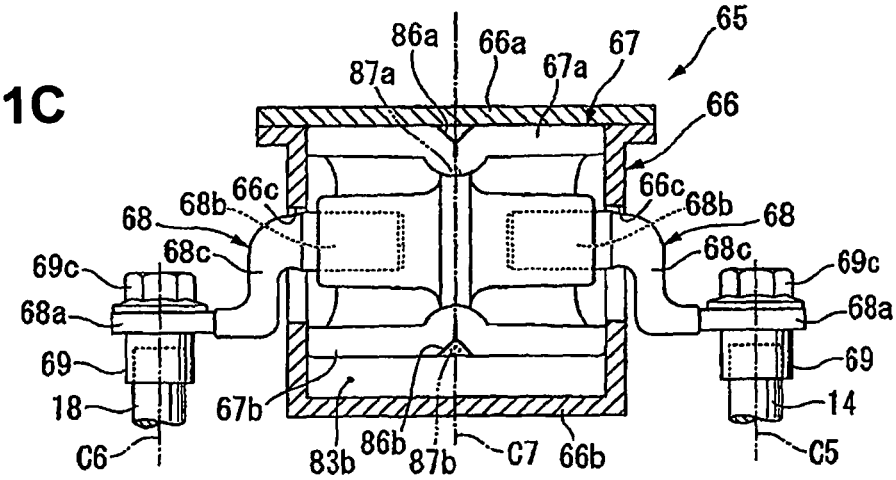
FIG. 21C illustrates, the air purging of the hydraulic cylinder, a state where the plunger has given a complete stroke.

Likewise, suppose that the plunger 67 has given a complete stroke towards the cover 66*a* of the hydraulic cylinder 66 (see FIG. 21C). In this state, the air-purge hole 87*b* on the side closer to the bottom portion 66*b* is positioned between the branched arm portions of the air-purge groove 86*b* on the same side, that is, on the side closer to the bottom portion 66*b*. The air-purge hole 87*a* on the side closer to the cover 66*a* is located at a position offset towards the bottom portion 66*b* from the single leg portion of the air-purge groove 86*a* on the same side, that is, on the side closer to the cover 66*a*. Each of the oil chambers 83*a* and 83*b* is thus kept in an oil-tight state.

Suppose that the plunger 67 that has been given a complete stroke towards either one of the bottom portion 66*b* and the cover 66*a* starts to give another stroke towards the other. Then, while the plunger 67 is giving the new stroke, the air-purge holes 87*a* and 87*b* are laid respectively over the single leg portions of the air-purge grooves 86*a* and 86*b* (see FIG. 21B). The leading ends of the branched arm portions of the air-purge groove 86*a* are opened to the oil chamber 83*a* while the leading ends of the branched arm portions of the air-purge groove 86*b* are opened to the oil chamber 83*b*. The air which has intruded into the oil chambers 83*a* and 83*b* and which remains in the upper-end portions of the oil chambers 83*a* and 83*b* is discharged out of the hydraulic cylinder 66 respectively via the air-purge groove 86*a* and then the air-purge hole 87*a* as well as via the air-purge groove 86*b* and then the air-purge hole 87*b*.

The hydraulic cylinder 66 is placed so that its portion located on the side closer to the bottom portion 66*b* in the axial direction can be laid over the right-hand end portions of the rocker-arm shafts 14 and 18. To put it differently, the hydraulic cylinder 66 is partially placed inside the cylinder head 2 until its portion located on the side closer to the bottom portion 66*b* in its axial direction is laid over the right-hand end portions of the rocker-arm shafts 14 and 18. Such a placement results in a reduction in the amount by which the hydraulic actuator 65 sticks out to the outside of the cylinder head 2.

Now, refer to FIGS. 17 and 18. The oil supply hole 75*a* formed in the right-hand portion of the oil gallery 75 is located at the right-hand side of the crankshaft 10, and is located right below but a predetermined distance away from the cam drive sprocket 52. The oil supply hole 75*a* is opened to the upper side, that is, opened towards the cam drive sprocket 52 (i.e., crankshaft 10).

When viewed in the up-and-down direction, the oil supply hole 75*a* is placed within an projection area of the crankshaft 10 (i.e., within the width, in the radial direction, of the crankshaft 10). The oil channel 79 connecting the oil supply hole 75*a* to the hydraulic actuator 65 includes a pipe 79A. The pipe 79A has a circular cross section, and extends inside the cam-chain chamber 54 while avoiding the crankshaft 10, the cam chains 53, and the like. For the sake of convenience, the portion around the crank shaft 10 is illustrated in FIG. 18 as seen from below while the side closer to the cylinders 30 is illustrated in FIG. 18 as seen, from the front side, in the direction orthogonal to the cylinder axis C2.

The pipe 79A (i.e., the oil channel 79) extends, firstly, upwards from the oil supply hole 75*a*, and then bends obliquely upward to the rear side and to the inner side of the engine 1 (i.e., to the inner side in the direction of the crankshaft 10). The pipe 79A thus shifts to a position between the cam drive sprocket 52 (the cam chain 53) and the rightmost one of crankshaft bearings 10*a* that is located at the left-hand side of, and is adjacent to, the cam drive sprocket 52. After that, the pipe 79A extends along a plane that is orthogonal to the right-and-left direction while curving obliquely upwards to the front side so as to go round the crankshaft 10.

Thereafter, the pipe 79A stays at the further inner side of the engine 1 than the cam chain 53, and extends obliquely towards the cylinder head 2. Then, in the vicinity of the base-end portion of the cylinder 30, the pipe 79A passes through the space located inside the looped cam chain 53 and thus shifts its position to a position located at further outer side of the engine 1 (outer side of the direction of the crankshaft 10) than the cam chain 53. When the cam chain 53 and its surrounding area are viewed, from the outside of the looped cam chain 53 and in a direction orthogonal to the cylinder axis C2 from the front side, the pipe 79A obliquely intersects the cam chain 53 while passing through the space inside the looped cam chain 53 (see FIG. 18).

The pipe 79A that has passed through the inside of the looped cam chain 53 and thus shifted its position to further outer side of the engine 1, extends at the further outer side of the engine 1 than the cam chain 53 towards the cylinder head 2 so as to be substantially parallel with the cylinder axis C2. The upper-end portion of the pipe 79A is connected to a lower-end portion of the hydraulic actuator 65. While the pipe 79A is extending upwards at the further outer side of the engine 1 than the cam chain 53, the pipe 79A is laid substantially over the tensile side of the cam chain 53 when viewed from a side of the engine 1 (see FIG. 17).

Figure 22:
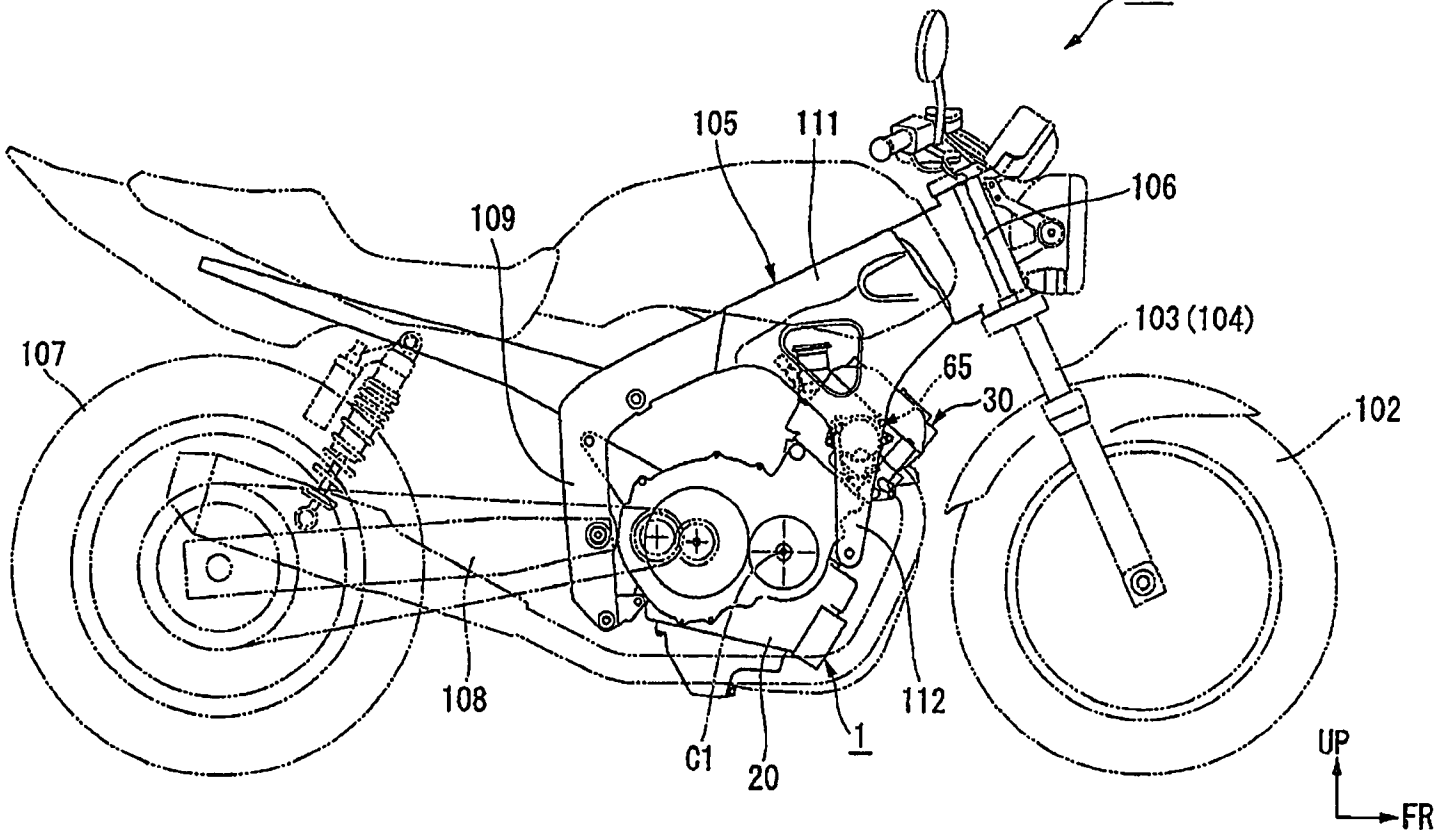
FIG. 22 is a right-side view of a motorcycle equipped with the engine.

FIG. 22 shows a right-side view of a motorcycle 101 equipped with the engine 1. A front wheel 102 is rotatably supported at the lower-end portions of a right and a left front forks 103. A front-wheel suspension system 104 that is composed mainly of the right and the left front forks 103 is pivotally supported by a head pipe 106 of a vehicle-body frame 105 so as to be steerable. A rear wheel 107 is rotatably supported at the rear-end portion of a rear swing arm 108. The front-end portion of the rear swing arm 108 is pivotally supported by a right and a left pivot plates 109 of the vehicle-body frame 105 located at a central portion, in the front-to-rear direction, of the vehicle body. The rear swing arm 108 thus supported is swingable up and down.

A right and a left main tubes 111 extend from the head pipe 106 obliquely downwards to the rear. The rear-end portions of the right and the left main tubes 111 are connected respectively to the upper-end portions of the right and the left pivot plates 109 at central portions, in the front-to-rear direction, of the vehicle body. The engine 1 is mounted below the right and the left main tubes 111.

A right and a left engine hangers 112 extend downwards respectively from the bottom sides of the front-side portions of the right and the left main tubes 111. The front-end portion of the engine 1 is supported by the lower-end portions of the right and the left engine hangers 112. The rear-end portion of the engine 1 is supported by the right and the left pivot plates 109 at appropriate positions in the up and down direction.

The right and the left engine hangers 112 are disposed respectively along the left-hand and the right-hand sidewalls of the cylinder head 2.

Figure 23:
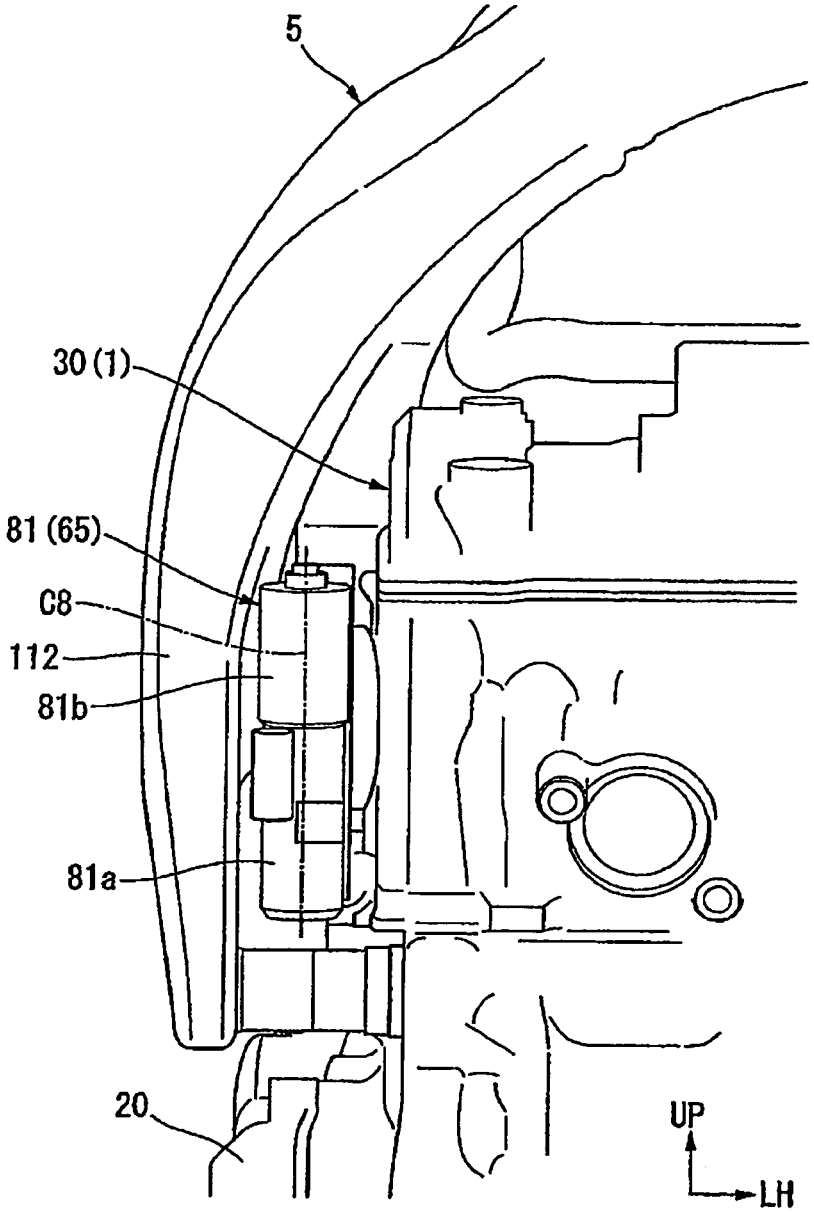
FIG. 23 is a front-side view illustrating areas surrounding the right-hand engine hanger of the motorcycle.

Now, refer also to FIG. 23. The right-hand engine hanger 112 is placed at the right-hand side of the hydraulic actuator 65. A gap is left between the right-hand engine hanger 112 and the right-hand sidewall of the cylinder head 2, and has a relatively small width in the right-and-left direction. Placed in this relatively narrow gap is the sticking-out portions of the hydraulic actuator 65 (including the spool valve 81) that sticks outwards from the cylinder head 2.

What follows is a description of the operation of the valve mechanism 5.

Suppose a case where the first rocker-arm moving mechanism 21 has to accumulate a predetermined force to move the rocker arm 13 that is located at the first operation position (see FIG. 4) to the second operation position. In this case, the hydraulic actuator 65 is firstly activated before the rocker arm 13 opens the valves 6. Thus the rocker-arm shaft 14 that is located at the limit position for the leftward movement is moved rightwards together with the spring receiving collars 25 and 26 (see FIG. 7A).

The movement of the rocker-arm shaft 14 in the axial direction surmounts the supported portions 37*c* of the trigger pin 37 on top of the left-hand slope 61*b* of the cut-away recessed portion 61. Accordingly, the trigger pin 37 moves in the orthogonal direction to the axis C5, so that the top portion of the trigger pin 37 pushes upwards the left-hand engagement nail 34 of the trigger arm 33 that has been in the pre-swing state. The left-hand engagement nail 34 is thus pushed out of the central engagement groove 36*b* by a predetermined amount, so that the trigger arm 33 swings clockwise in FIG. 7B (i.e., the trigger arm 33 swings to the opposite side to the rocker arm 13).

At this time, when viewed in the direction of the axis C5, the upper-end portion 38*a* of the left-hand deck-like portion 38 of the rocker arm 13 and the lower-edge portion 34*a* of the left-hand engagement nail 34 of the trigger arm 33 overlap each other by a predetermined amount. Accordingly, the upper-end portion 38*a* of the left-hand deck-like portion 38 and the lower-edge portion 34*a* of the left-hand engagement nail 34 are brought into contact with each other in the direction of the axis C5, so that the overlapping portions restricts the rightward movement of the rocker arm 13 relative to the trigger arm 33 (i.e., relative to the cylinder head 2).

In addition, at this time, when viewed in the direction of the axis C5, the upper-end portion 39*a* of the right-hand deck-like portion 39 of the rocker arm 13 and the lower-edge portion 35*a* of the right-hand engagement nail 35 of the trigger arm 33 overlap each other by a predetermined amount. However, a gap S is left, in the direction of the axis C5, between the upper-end portion 39*a* of the right-hand deck-like portion 39 and the lower-edge portion 35*a* of the right-hand engagement nail 35.

Suppose that the rocker-arm shaft 14 and the spring receiving collars 25 and 26 have been moved from their respective limit positions for the leftward movement to their respective limit positions for the rightward movement. By this time, the first spring 23 placed between the first-spring receiving collar 25 and the shaft-insertion boss 13*a* of the rocker arm 13 subjected to the movement restriction has been compressed by a predetermined amount. Accordingly, the first spring 23 has accumulated a spring force that is large enough to move the rocker arm 13 from the first operation position to the second operation position.

Now suppose a case where: the rocker arm 13 is located at the first operation position; the rocker-arm shaft 14 is located at the limit position for the rightward movement; and the trigger arm 33 is in the primary swing state. In this case, if the left-hand and the right-hand first cams 15*a* and 16*a* are driven by the rotation of the intake-side cam shaft 11 to make the rocker arm 13 swing from the valve-closing side to the valve-opening side (i.e., the cams 15*a* and 16*a* press the rocker arm 13 to lift the intake valves 6; see FIG. 8), the shaft-insertion boss 13*a* moves rotationally and the rotational movement lowers down the upper-end portion 38*a* of the left-hand deck-like portion 38 and raises a little the upper-end portion 39*a* of the right-hand deck-like portion 39 (see FIG. 9A).

Then, suppose that, during a predetermined valve operation period that extends across a point of time when each of the intake valves 6 is lifted by a maximum amount, the overlapping margin of the upper-end portion 38*a* of the left-hand deck-like portion 38 and the lower-edge portion 34*a* of the left-hand engagement nail 34 becomes zero when viewed in the direction of the axis C5 (i.e., the contact margin in the direction of the axis C5 disappears). Then, the restriction imposed by such an overlapping portions on the rightward movement of the rocker arm 13 relative to the cylinder head 2 is removed.

At this time, a certain overlapping margin is still secured between the upper-end portion 39*a* of the right-hand deck-like portion 39 and the lower-edge portion 35*a* of the right-hand engagement nail 35 when viewed in the direction of the axis C5. If the restriction imposed on the rightward movement of the rocker arm 13 by the engagement of the left-hand deck-like portion 38 and the left-hand engagement nail 34 is removed as has been described above, the rocker arm 13 moves rightwards by an amount equivalent to the gap S between the right-hand deck-like portion 39 and the right-hand engagement nail 35 (see FIG. 9B).

At this time, the upper-end portion 39*a* of the right-hand deck-like portion 39 and the lower-edge portion 35*a* of the right-hand engagement nail 35 are brought into contact with each other in the direction of the axis C5. Accordingly, the rightward movement of the rocker arm 13 relative to the cylinder head 2 is restricted. Also at this time, the upper-end portion 38*a* of the left-hand deck-like portion 38 and the lower-edge portion 34*a* of the left-hand engagement nail 34 overlap each other by an amount equivalent to the gap S in the direction of the axis C5.

Then, suppose that, while the left-hand deck-like portion 38 and the left-hand engagement nail 34 overlap each other by a predetermined amount in the direction of the axis C5 as described above, the intake-side cam shaft 11 is continuously driven to rotate and the rocker arm 13 is made to swing from the valve-opening side to the valve-closing side. Then, the upper-end portion 38*a* of the left-hand deck-like portion 38 slidingly contacts the lower-edge portion 34*a* of the left-hand engagement nail 34, and the trigger arm 33 is made to move rotationally further clockwise in FIG. 8 from the primary swing state.

By the time when the rocker arm 13 swings so that the lift amount of each intake valve 6 becomes zero (i.e., so that the valves 6 are closed completely), the overlapping margin of the upper-end portion 39*a* of the right-hand deck-like portion 39 and the lower-edge portion 35*a* of the right-hand engagement nail 35 has become zero when viewed in the direction of the axis C5 (i.e., the contacting margin in the direction of the axis C5 has disappeared). Then, the restriction imposed by such an overlapping portions on the rightward movement of the rocker arm 13 relative to the cylinder head 2 is removed (see FIG. 10A).

At this time, the restriction imposed on the movement of the rocker arm 13 by the engagement of the left-hand deck-like portion 38 and the left-hand engagement nail 34 has already been removed as well. Accordingly, the spring force accumulated by the first spring 23 moves the rocker arm 13 to the second operation position (see FIG. 10B). Then, the left-hand engagement nail 34 and the left-hand protruding piece 43 overlap the left-hand position-restriction portion 41 by a predetermined amount when viewed in the direction of the axis C5. In addition the left-hand engagement nail 34 and the left-hand protruding piece 43 contact each other in the direction of the axis C5, so that a restriction is imposed on the position of the rocker arm 13 located at the second operation position.

Once the movement of the rocker arm 13 to the second operation position has been completed, the left-hand and the right-hand engagement nails 34 and 35 are positioned right above the left-hand and the central engagement grooves 36*a* and 36*b* respectively. In this state, a counterclockwise rotational movement of the trigger arm 33 (towards the rocker arm 13) in FIG. 8 makes the left-hand and the right-hand engagement nails 34 and 35 enter the left-hand and the central engagement grooves 36*a* and 36*b*, respectively. At this time the supported portions 37*c* of the trigger pin 37 are moved to the top of the bottom face 61*a* of the cut-away recessed portion 61, and thus the trigger pin 37 is lowered down inside the central engagement groove 36*b*. Accordingly, the trigger arm 33 returns to the pre-swing state, so that a restriction is imposed on the sliding movement, in the direction of the axis C5, of the rocker arm 13 located at the second operation position.

Note that, while the trigger arm 33 is in the pre-swing state, even a swing of the rocker arm 13 does not make the overlapping margin of the left-hand deck-like portion 38 and the left-hand engagement nail 34 disappear completely. Accordingly, the restriction continues to be imposed on the rightward movement of the rocker arm 13 until the trigger arm 33 becomes the primary swing state (that is, until the first spring 23 accumulates a predetermined force).

Subsequently, suppose a case where the second rocker-arm moving mechanism 22 has to accumulate a predetermined force to move the rocker arm 13 that is located at the second operation position (see FIG. 11) to the first operation position. In this case, the hydraulic actuator 65 is firstly activated before the rocker arm 13 opens the valves 6. Thus the rocker-arm shaft 14 that is located at the limit position for the rightward movement is moved leftwards together with the spring receiving collars 25 and 26 (see FIG. 12).

The movement of the rocker-arm shaft 14 in the axial direction surmounts the supported portions 37 of the trigger pin 37 on top of the right-hand slope 61*c* of the cut-away recessed portion 61. Accordingly, the trigger pin 37 moves in the orthogonal direction to the axis C5, so that the top portion of the trigger pin 37 pushes upwards the right-hand engagement nail 35 of the trigger arm 33 that has been in the pre-swing state. The right-hand engagement nail 35 is thus pushed out of the central engagement groove 36*b* by a predetermined amount, so that the trigger arm 33 swings clockwise in FIG. 7B (i.e., the trigger arm 33 swings to the opposite side to the rocker arm 13).

At this time, when viewed in the direction of the axis C5, the upper-end portion 38*a* of the left-hand deck-like portion 38 of the rocker arm 13 and the lower-edge portion 34*a* of the left-hand engagement nail 34 of the trigger arm 33 overlap each other by a predetermined amount. Accordingly, the upper-end portion 38*a* of the left-hand deck-like portion 38 and the lower-edge portion 34*a* of the left-hand engagement nail 34 are brought into contact with each other in the direction of the axis C5, so that the overlapping portions restricts the leftward movement of the rocker arm 13 relative to the trigger arm 33 (i.e., relative to the cylinder head 2).

In addition, at this time, when viewed in the direction of the axis C5, the upper-end portion 39*a* of the right-hand deck-like portion 39 of the rocker arm 13 and the lower-edge portion 35*a* of the right-hand engagement nail 35 of the trigger arm 33 overlap each other by a predetermined amount. However, a gap S is left, in the direction of the axis C5, between the upper-end portion 39*a* of the right-hand deck-like portion 39 and the lower-edge portion 35*a* of the right-hand engagement nail 35.

Suppose that the rocker-arm shaft 14 and the spring receiving collars 25 and 26 have been moved from their respective limit positions for the rightward movement to their respective limit positions for the leftward movement. By this time, the second spring 24 placed between the second-spring receiving collar 26 and the shaft-insertion boss 13*a* of the rocker arm 13 subjected to the movement restriction has been compressed by a predetermined amount. Accordingly, the second spring 24 has accumulated a spring force that is large enough to move the rocker arm 13 from the second operation position to the first operation position.

Figure 13A:
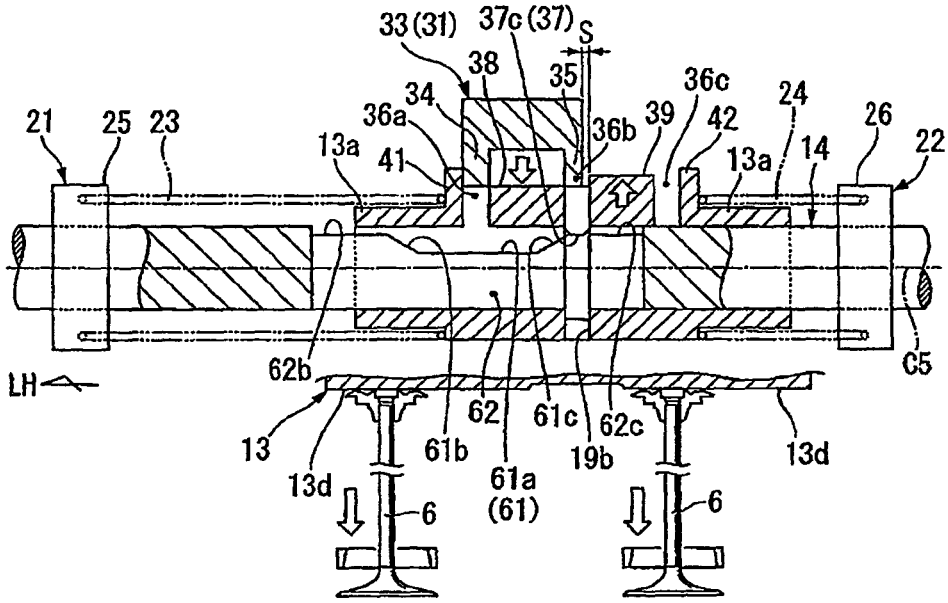
FIG. 13A is a sectional view corresponding to FIG. 11 but illustrating a state accomplished when the state of FIG. 12 is turned into another state where the rocker arm is turned to be in a valve opening state.

Now suppose a case where: the rocker arm 13 is located at the second operation position; the rocker-arm shaft 14 is located at the limit position for the leftward movement; and the trigger arm 33 is in the primary swing state. In this case, if the left-hand and the right-hand second cams 15*b* and 16*b* are driven by the rotation of the intake-side cam shaft 11 to make the rocker arm 13 swing from the valve-closing side to the valve-opening side (i.e., the cams 15*b* and 16*b* press the rocker arm 13 to lift the intake valves 6; see FIG. 8), the shaft-insertion boss 13*a* moves rotationally and the rotational movement lowers down the upper-end portion 38*a* of the left-hand deck-like portion 38 and raises a little the upper-end portion 39*a* of the right-hand deck-like portion 39 (see FIG. 13A).

Then, suppose that, during a predetermined valve operation period that extends across a point of time when each of the intake valves 6 is lifted by a maximum amount, the overlapping margin of the upper-end portion 38*a* of the left-hand deck-like portion 38 and the lower-edge portion 34*a* of the left-hand engagement nail 34 becomes zero when viewed in the direction of the axis C5 (i.e., the contact margin in the direction of the axis C5 disappears). Then, the restriction imposed by such an overlapping portions on the leftward movement of the rocker arm 13 relative to the cylinder head 2 is removed.

Figure 13B:
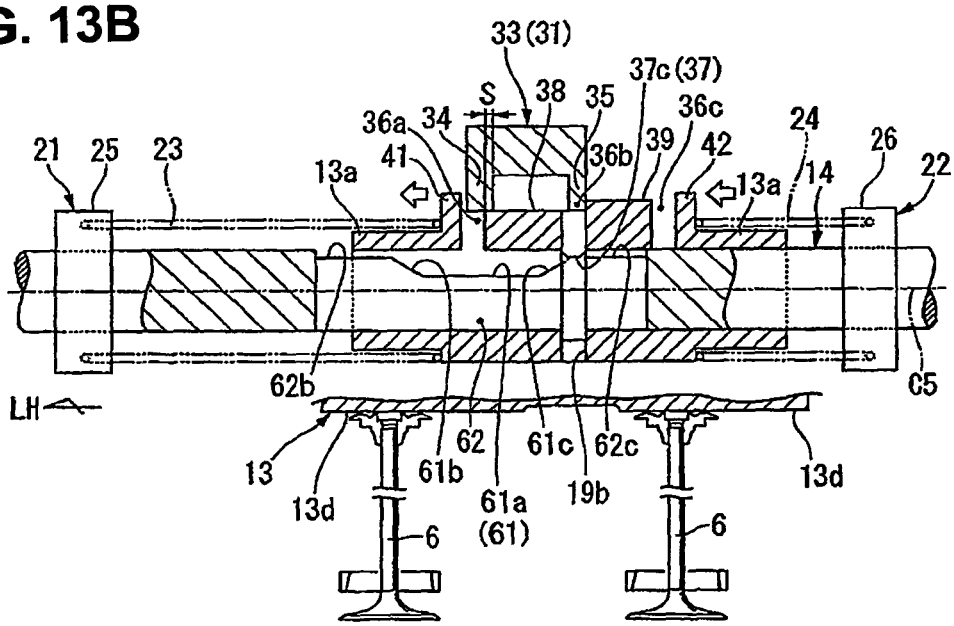
FIG. 13B is a sectional view corresponding to FIG. 11 but illustrating a state accomplished when the rocker arm moves in the axial direction by an amount equivalent to a gap S from its state shown in FIG. 13A.

At this time, a certain overlapping margin is still secured between the upper-end portion 39*a* of the right-hand deck-like portion 39 and the lower-edge portion 35*a* of the right-hand engagement nail 35 when viewed in the direction of the axis C5. If the restriction imposed on the leftward movement of the rocker arm 13 by the engagement of the left-hand deck-like portion 38 and the left-hand engagement nail 34 is removed as has been described above, the rocker arm 13 moves leftwards by an amount equivalent to the gap S between the right-hand deck-like portion 39 and the right-hand engagement nail 35 (see FIG. 13B).

At this time, the upper-end portion 39*a* of the right-hand deck-like portion 39 and the lower-edge portion 35*a* of the right-hand engagement nail 35 are brought into contact with each other in the direction of the axis C5. Accordingly, the leftward movement of the rocker arm 13 relative to the cylinder head 2 is restricted. Also at this time, the upper-end portion 38*a* of the left-hand deck-like portion 38 and the lower-edge portion 34*a* of the left-hand engagement nail 34 overlap each other by an amount equivalent to the gap S in the direction of the axis C5.

Then, suppose that, while the left-hand deck-like portion 38 and the left-hand engagement nail 34 overlap each other by a predetermined amount in the direction of the axis C5 as described above, the intake-side cam shaft 11 is continuously driven to rotate and the rocker arm 13 is made to swing from the valve-opening side to the valve-closing side. Then, the upper-end portion 38*a* of the left-hand deck-like portion 38 slidingly contacts the lower-edge portion 34*a* of the left-hand engagement nail 34, and the trigger arm 33 is made to move rotationally further clockwise in FIG. 8 from the primary swing state.

Figure 14A:
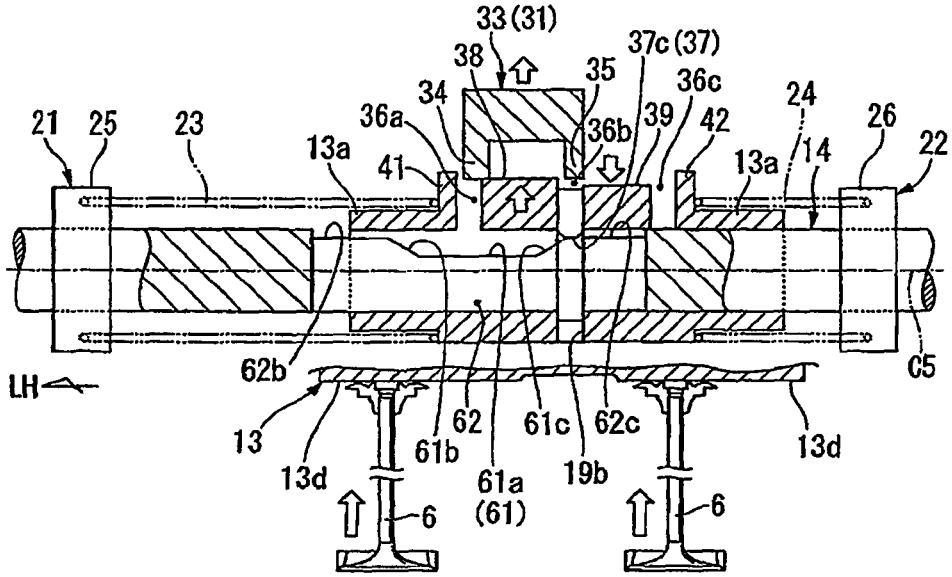
FIG. 14A is a sectional view corresponding to FIG. 11 but illustrating a state accomplished when the state of FIG. 13B is turned into another state where the rocker arm is turned to be in a valve closing state.

By the time when the rocker arm 13 swings so that the lift amount of each intake valve 6 becomes zero (i.e., so that the valves 6 are closed completely), the overlapping margin of the upper-end portion 39*a* of the right-hand deck-like portion 39 and the lower-edge portion 35*a* of the right-hand engagement nail 35 has become zero when viewed in the direction of the axis C5 (i.e., the contacting margin in the direction of the axis C5 has disappeared). Then, the restriction imposed by such an overlapping portions on the leftward movement of the rocker arm 13 relative to the cylinder head 2 is removed (see FIG. 14A).

Figure 14B:
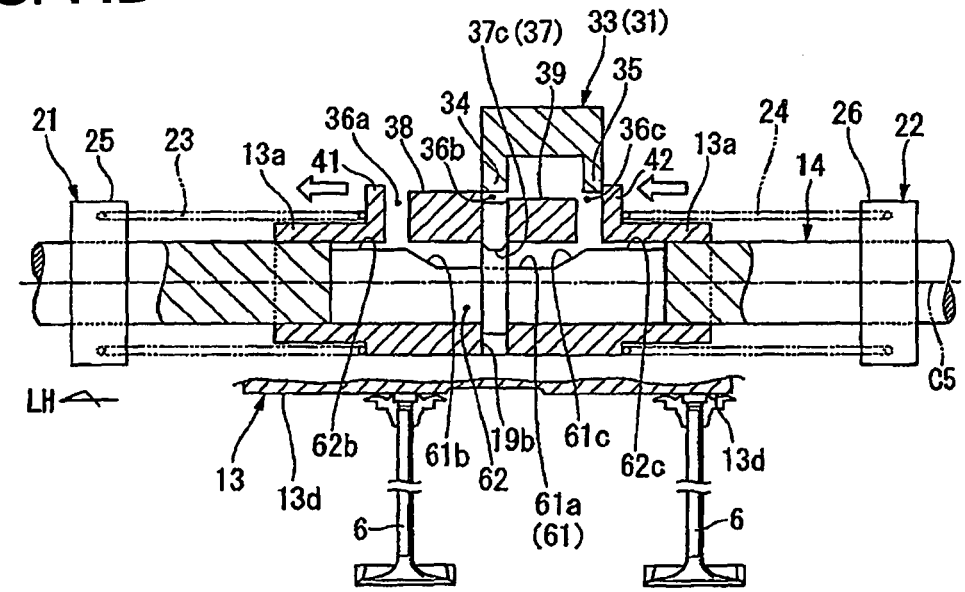
FIG. 14B is a sectional view corresponding to FIG. 11 but illustrating a state accomplished when the state of FIG. 14A is turned into another state where the rocker arm moves to the first operation position.

At this time, the restriction imposed on the movement of the rocker arm 13 by the engagement of the left-hand deck-like portion 38 and the left-hand engagement nail 34 has already been removed as well. Accordingly, the spring force accumulated by the second spring 24 moves the rocker arm 13 to the first operation position (see FIG. 14B). Then, the right-hand engagement nail 35 and the right-hand protruding piece 44 overlap the right-hand position-restriction portion 42 by a predetermined amount when viewed in the direction of the axis C5. In addition, the right-hand engagement nail 35 and the right-hand protruding piece 44 contact each other in the direction of the axis C5, so that a restriction is imposed on the position of the rocker arm 13 located at the first operation position.

Once the movement of the rocker arm 13 to the first operation position has been completed, the left-hand and the right-hand engagement nails 34 and 35 are positioned right above the central and the right-hand engagement grooves 36*b* and 36*c* respectively. In this state, a counterclockwise rotational movement of the trigger arm 33 (towards the rocker arm 13) in FIG. 8 makes the left-hand and the right-hand engagement nails 34 and 35 enter the central and the right-hand engagement grooves 36*b* and 36*c*, respectively. At this time the supported portions 37*c* of the trigger pin 37 are moved to the top of the bottom face 61*a* of the cut-away recessed portion 61, and thus the trigger pin 37 is lowered down inside the central engagement groove 36*b*. Accordingly, the trigger arm 33 returns to the pre-swing state, so that a restriction is imposed on the sliding movement, in the direction of the axis C5, of the rocker arm 13 located at the first operation position.

Note that, while the trigger arm 33 is in the pre-swing state, even a swing of the rocker arm 13 does not make the overlapping margin of the left-hand deck-like portion 38 and the left-hand engagement nail 34 disappear completely. Accordingly, the restriction continues to be imposed on the leftward movement of the rocker arm 13 until the trigger arm 33 becomes the primary swing state (that is, until the second spring 24 accumulates a predetermined force).

As has been described thus far, the opening-closing timings for the intake valves 6 and the lift amount for the valves 6 are switched appropriately (i.e., are made variable) between a case where the engine 1 is not in operation or is running (crankshaft 10 revolves) at a low speed and a case where the engine 1 is running at a high speed. Accordingly, while the engine 1 is running at a low speed, the valve overlap can be reduced and the lift amount can be decreased. In contrast, while the engine 1 is running at a high speed, the valve overlap can be increased and the lift amount can be increased.

As has been described thus far, in the engine 1 equipped with a variable valve control system according to the embodiment, the intake-side rocker arm 13 (or the exhaust-side rocker arm 17) is disposed between the intake engine valves 6 (or the exhaust valves 7) and the left-hand and the right-hand first cams 15*a* and 16*a* as well as between the intake engine valves 6 and the left-hand and the right-hand second cams 15*b* and 16*b* for the intake valves 6. The rocker arm 13 is supported by the intake-side rocker-arm shaft 14 (or the exhaust-side rocker-arm shaft 18) swingably and slidably in the axial direction of the intake-side rocker-arm shaft 14. The rocker arm 13 (or the rocker arm 17) engages selectively with one of the two combinations of cams—either the combination of the first cams 15*a* and 16*a* or the combination of the second cams 15*b* and 16*b* by a sliding movement of the rocker arm 13 (or the rocker arm 17) in the axial direction in response to the movement of the rocker-arm shaft 14 (or the rocker-arm shaft 18), and thus the actions of the intake valves 6 (or the exhaust valves 7) are switched from one to the other. The engine 1 includes the trigger arm 33 that is a member provided separately from the rocker arms 13 and 17. The trigger arm 33 is swingably supported by the support shaft 32 which is fixed to the cylinder head 2 of the engine 1 and which is parallel with the rocker-arm shafts 14 and 18. When the trigger arm 33 swings towards the rocker arm 13 or 17 and engages with the rocker arm 13 or 17, the sliding movement of the rocker arm 13 or 17 is made impossible. When the trigger arm 33 swings away from the rocker arm 13 or 17 and disengages from the rocker arm 13 or 17, the sliding movement of the rocker arm 13 or 17 is allowed. The rocker arms 13 and 17 include, respectively, the position-restriction portions 41 and 42. Each of the position-restriction portions 41 and 42 abuts on the trigger arm 33 so as to restrict the sliding movement of the corresponding one of the rocker arms 13 and 17 within a predetermined amount when the trigger arm 33 is disengaged from the corresponding one of the rocker arms 13 and 17.

According to this configuration, the trigger arm 33 that engages with the rocker arm 13 or 17 so as to make the sliding movement of the rocker arm 13 or 17 impossible is provided. In addition, when the trigger arm 33 disengages from the rocker arm 13 or 17 to allow the sliding movement of the rocker arm 13 or 17, the position-restriction portion 41 or 42 formed in the rocker arm 13 or 17 abut on the trigger arm 33 so that the sliding movement of the rocker arm 13 or 17 can be restricted within a predetermined amount. Consequently, the sliding movement of the rocker arm 13 or 17 can be restricted within the predetermined amount by means of a simple structure without increasing the number of component parts.

In addition, the engine 1 may have the following configuration. The trigger arm 33 includes the engagement nails 34 and 35, and the engagement grooves 36*a*, 36*b*, and 36*c* are formed in the rocker arm 13 or 17. The sliding movement of the rocker arm 13 or 17 is made impossible by the engagement of the engagement nails 34 and 35 with the corresponding engagement grooves 36*a*, 36*b*, and 36*c*. The position-restriction portions 41 and 42 are formed as protrusions that are formed by extending the sidewalls of the corresponding engagement grooves 36*a* and 36*c*. Accordingly, the position-restriction portions 41 and 42 are formed as protrusions that have sidewalls contiguously formed from the sidewalls of the corresponding engagement grooves 36*a* and 36*c*. Accordingly, when the engagement nails 34 and 35 disengage respectively from the engagement grooves 36*a* and 36*c*, the engagement nails 34 and 35 can be guided smoothly respectively along the sidewalls of the engagement grooves 36*a* and 36*c*. Consequently, the restriction imposed by the engagement nails 34 and 35 on the sliding movement of the rocker arm 13 or 17 can be cancelled smoothly. In addition, the position-restriction portions 41 and 42 can be formed easily.

In addition, the engine 1 may have the following configuration. The protruding pieces 43 and 44 configured to abut on the position-restriction portions 41 and 42 respectively are formed as separate bodies from the engagement nails 34 and 35, in the trigger arm 33. Accordingly, the protruding pieces 43 and 44 that are formed as separate bodies from the engagement nails 34 and 35 are made to abut respectively on the position-restriction portions 41 and 42 of the rocker arm 13 or 17. Accordingly, in contrast to the case where the restriction on the sliding movement of the rocker arm 13 or 17 is imposed by the engagement nails 34 and 35 alone, the load that derives from the restriction on the sliding movement of the rocker arm 13 or 17 can be received also by the protruding pieces 43 and 44. The influence on the engagement nails 34 and 35 can be reduced so that the restriction imposed on the sliding movement of the rocker arm 13 or 17 can be accomplished reliably and accurately.

In addition, the engine 1 may have the following configuration. The engagement nails 34 and 35 are made of plate-shaped members that extend from the support-shaft 32 side of the trigger arm 33 towards the rocker arm 13 or 17. The cut-away portions 45 and 46 each of which has an open side facing the rocker arm 13 or 17 are formed respectively in the plate-shaped members. In each of the plate-shaped members, the protruding piece 43 or 44 is formed in a portion that is opposed to the corresponding engagement nail 34 or 35 across the corresponding cut-away portion 45 or 46. Accordingly, both each engagement nail 34 or 35 and the corresponding protruding piece 43 or 44 are formed as parts of the corresponding plate-shaped member that extends from the support-shaft 32 side of the trigger arm 33 towards the rocker arm 13 or 17. Consequently, the engagement nails 34 and 35 as well as the protruding pieces 43 and 44 can be formed easily without increasing the number of component parts.

In addition, the engagement nail 34 or 35 and the corresponding protruding piece 43 or 44 are formed so as to be separated from each other with the corresponding cut-away portion 45 or 46 in between. Consequently, the influence that the abutting of the protruding piece 43 or 44 on the corresponding position-restriction means 41 or 42 has on the corresponding engagement nail 34 or 35 can be reduced.

In addition, the engine 1 may have the following configuration. A pair of the engagement nails 34 and 35 are formed so as to be arranged in the axial direction of the support shaft 32, and a pair of the protruding pieces 43 and 44 are formed so as to be arranged in the axial direction of the support shaft 32. Each of the cut-away portions 45 and 46 has a chevron shape when viewed in the axial direction of the support shaft 32. The connecting wall 33*b* is formed in the vicinity of the vertex angles θ1 and θ2 of the cut-away portions 45 and 46 so as to connect the pair of the engagement nails 34 and 35 with each other as well as to connect the pair of the protruding pieces 43 and 44 with each other. Accordingly, the engagement nails 34 and 35 are connected with each other and the protruding pieces 43 and 44 are connected with each other so that the engagement nails 34 and 35 as well as the protruding pieces 43 and 44 can have higher rigidity. In addition, the portions in the vicinities of the vertex angles θ1 and θ2 of the cut-away portions 45 and 46 each of which has a chevron shape when viewed in the axial direction of the support shaft 32 (i.e., in the vicinities of the support shaft 32) can be reinforced. Consequently, the influence that the abutting of the protruding piece 43 or 44 on the corresponding position-restriction portion 41 or 42 has on the corresponding engagement nail 34 or 35 can be further reduced.

In addition, the engine 1 may have the following configuration. Each of the vertex angles θ1 and θ2 of the cut-away portions 45 and 46 is an obtuse angle. Accordingly, the concentration of stress on the vicinity of the vertex angles θ1 and θ2 of the cut-away portions 45 and 46 can be reduced. In addition, the separation of each of the engagement nails 34 and 35 from the corresponding protruding piece 43 or 44 results in a further reduction in the influence that the abutting of the protruding piece 43 or 44 on the corresponding position-restriction portions 41 or 42 has on the corresponding engagement nail 34 or 35.

Note that the configuration described in the embodiment above is only an example of the present invention. Various modifications can be made without departing from the scope of the invention. For example, the accumulator 84 shown in FIG. 20 is not essential for the implementation of the present invention, so the accumulator 84 may be omitted. In addition, the information on the gear position and on the negative pressure inside the intake pipe, which is inputted into the ECU 78, may be omitted as well.

In other words, although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. An internal combustion engine equipped with a cylinder head and comprising a variable valve control system in which a rocker arm is disposed between an engine valve and first and second cams for the engine valve, wherein the rocker arm is pivotally supported by a rocker arm shaft and is slidably movable thereon in an axial direction of the rocker arm shaft, in response to a movement of the rocker arm shaft, to selectively engage with one of said cams, whereby control of the engine valve is switchable between said cams, said internal combustion engine comprising:

a stopper provided separately from the rocker arm, and swingably supported on the cylinder head of the internal combustion engine by use of a support shaft mounted on said cylinder head parallel to the rocker-arm shaft, wherein when the stopper swings towards the rocker arm and engages with the rocker arm, the rocker arm is prohibited from sliding, when the stopper swings away from the rocker arm and disengages from the rocker arm, the rocker arm is allowed to slide, and the rocker arm includes a blocking member that is configured and arranged to limit slidable movement of the stopper, so as to restrict the sliding movement of the rocker arm within a predetermined range, when the stopper disengages from the rocker arm.

2. The internal combustion engine equipped with a variable valve control system according to claim 1, wherein:

the rocker arm includes an engagement groove formed therein, the engagement groove configured to engage with an engagement nail of the stopper to prohibit the rocker arm from sliding, and the blocking member is formed by extending a sidewall of the rocker arm upwardly in an area thereof adjacent the engagement groove.

3. The internal combustion engine equipped with a variable valve control system according to claim 2, wherein the stopper comprises a protruding piece extending in a different direction from the engagement nail and configured to abut on the blocking member.

4. The internal combustion engine equipped with a variable valve control system according to claim 3, wherein the stopper comprises a plate-shaped member that extends from a support-shaft side of the stopper towards the rocker arm and which has the engagement nail formed integrally thereon, and the protruding piece is formed on the plate-shaped member in a location disposed across a cut-away portion thereof that has an open side facing toward the rocker arm.

5. The internal combustion engine equipped with a variable valve control system according to claim 4, wherein the stopper comprises:

a pair of the plate-shaped members spaced apart in the axial direction of the support shaft, each of said plate-shaped members comprising an engagement nail and a protruding piece with a cut-away portion formed therebetween, and a connecting portion extending between said plate-shaped members, the connecting portion configured to connect the engagement nails with each other and the protruding pieces with each other in a vicinity of a respective vertex of each of the cut-away portions that has a chevron shape, when viewed in the axial direction of the support shaft.

6. The internal combustion engine equipped with a variable valve control system according to claim 4, wherein the vertex angle of the cut-away portion is an obtuse angle.

7. The internal combustion engine equipped with a variable valve control system according to claim 5, wherein the vertex angle of the cut-away portion is an obtuse angle.

8. The internal combustion engine equipped with a variable valve control system according to claim 5, wherein the connecting portion has a hole formed therein between the plate-like members.

9. An internal combustion engine equipped with a cylinder head and comprising a variable valve control system in which a rocker arm is disposed between an engine valve and first and second cams for the engine valve, wherein the rocker arm is pivotally supported by a rocker arm shaft and is slidably movable thereon in an axial direction of the rocker arm shaft, in response to a movement of the rocker arm shaft, to selectively engage with one of said cams, whereby control of the engine valve is switchable between said cams, said internal combustion engine comprising:

a stopper support shaft mounted on said cylinder head parallel to said rocker arm shaft;

a stopper which is pivotally supported by said stopper support shaft, wherein when the stopper swings towards the rocker arm and engages with the rocker arm, the rocker arm is prohibited from sliding, when the stopper swings away from the rocker arm and disengages from the rocker arm, the rocker arm is allowed to slide, and the rocker arm comprises a pair of spaced-apart blocking members that are configured and arranged to limit slidable movement of the stopper, so as to restrict the sliding movement of the rocker arm within a predetermined range, when the stopper disengages from the rocker arm.

10. The internal combustion engine equipped with a variable valve control system according to claim 9, wherein the rocker arm has a plurality of engagement grooves formed therein, each of the engagement grooves configured to selectively engage with an engagement nail of the stopper to temporarily prohibit the rocker arm from sliding, and the blocking members are formed by extending two spaced apart sidewall portions of the rocker arm upwardly in areas thereof adjacent the respective engagement grooves.

11. The internal combustion engine equipped with a variable valve control system according to claim 10, wherein the stopper comprises a protruding piece extending in a different direction from the engagement nail and configured to abut on one of said blocking members.

12. The internal combustion engine equipped with a variable valve control system according to claim 11, wherein the stopper comprises a plate-shaped member that extends from a support-shaft side of the stopper towards the rocker arm and which has the engagement nail formed integrally thereon, the plate-shaped member having a cut-away portion formed therein which separates the engagement nail from the protruding piece, said cut-away portion having an open side facing toward the rocker arm.

13. The internal combustion engine equipped with a variable valve control system according to claim 12, wherein the stopper comprises:

a pair of plate-shaped members spaced apart in the axial direction of the support shaft, each of said plate-shaped members comprising an engagement nail and a protruding piece with a cut-away portion formed therebetween, and a connecting portion extending between said plate-shaped members, the connecting portion configured to connect the engagement nails with each other and the protruding pieces with each other in a vicinity of a respective vertex of each of the cut-away portions that has a chevron shape, when viewed in the axial direction of the support shaft.

14. The internal combustion engine equipped with a variable valve control system according to claim 12, wherein the vertex angle of the cut-away portion is an obtuse angle.

15. The internal combustion engine equipped with a variable valve control system according to claim 13, wherein the vertex angle of the cut-away portion is an obtuse angle.

16. The internal combustion engine equipped with a variable valve control system according to claim 13, wherein the connecting portion has a hole formed therein between the plate-like members.

17. An internal combustion engine equipped with a cylinder head and comprising a variable valve control system in which a rocker arm is disposed between an engine valve and first and second cams for the engine valve, wherein the rocker arm is pivotally supported by a rocker arm shaft and is slidably movable thereon in an axial direction of the rocker arm shaft, in response to a movement of the rocker arm shaft, to selectively engage with one of said cams, whereby control of the engine valve is switchable between said cams, said internal combustion engine comprising:

a stopper support shaft mounted on said cylinder head parallel to said rocker arm shaft, said stopper support shaft having a central axis;

a stopper which is pivotally supported by said stopper support shaft, said stopper comprising:

a pair of plate-shaped members spaced apart in the axial direction of the support shaft, each of said plate-shaped members comprising an engagement nail and a protruding piece with a cut-away portion formed therebetween, the protruding piece extending in a different direction from the engagement nail and extending a shorter distance away from the central axis of the stopper support shaft than the engagement nail; and a connecting portion extending between said plate-shaped members, the connecting portion configured to connect the engagement nails with each other and the protruding pieces with each other in a vicinity of a respective vertex of each of the cut-away portions that has a chevron shape, when viewed in the axial direction of the support shaft;

wherein the rocker arm has a plurality of engagement grooves formed therein, each of the engagement grooves configured to selectively engage with an engagement nail of the stopper to temporarily prohibit the rocker arm from sliding;

wherein the rocker arm comprises a pair of spaced-apart blocking members that are configured and arranged to limit slidable movement of the stopper, so as to restrict the sliding movement of the rocker arm within a predetermined range, when the stopper disengages from the rocker arm; and wherein the blocking members are formed by extending two spaced apart sidewall portions of the rocker arm upwardly in areas thereof adjacent the respective engagement grooves.

18. The internal combustion engine equipped with a variable valve control system according to claim 17, wherein each of said plate-shaped members has a cut-away portion formed therein which separates the engagement nail from the protruding piece, said cut-away portion having an open side facing toward the rocker arm.

19. The internal combustion engine equipped with a variable valve control system according to claim 17, wherein the vertex angle of the cut-away portion is an obtuse angle.

20. The internal combustion engine equipped with a variable valve control system according to claim 18, wherein the vertex angle of the cut-away portion is an obtuse angle.

* * * * *